United States Patent [19]

Scott et al.

[11] 4,291,604

[45] Sep. 29, 1981

[54] MEMORY OVERRIDE SYSTEM FOR PROGRAMMED ELECTRONIC SYNTHESIZER

[75] Inventors: James L. Scott, Jacksonville; David A. Luce, Clarence Center, both of N.Y.

[73] Assignee: Norlin Industries, Inc., Deerfield, Ill.

[21] Appl. No.: 62,562

[22] Filed: Aug. 1, 1979

[51] Int. Cl.[3] ..... G10H 1/12; G10H 1/46

[52] U.S. Cl. ..... 84/1.19; 84/1.21; 84/1.27

[58] Field of Search ..... 84/1.01, 1.03, 1.11–1.13, 84/1.19, 1.21, 1.24–1.27

[56] References Cited

U.S. PATENT DOCUMENTS

| | | | |
|---|---|---|---|
| 3,801,721 | 4/1974 | Bunger | 84/1.19 |
| 3,881,387 | 5/1975 | Kawakami | 84/1.24 |
| 3,930,429 | 1/1976 | Hill | 84/1.01 |
| 3,948,139 | 4/1976 | Melcher et al. | 84/1.19 |
| 3,981,218 | 9/1976 | Luce | 84/1.24 |
| 3,992,969 | 11/1976 | Robinson et al. | 84/1.01 |
| 3,999,458 | 12/1976 | Suzuki | 84/1.01 |
| 4,050,343 | 9/1977 | Moog | 84/1.01 |
| 4,106,383 | 8/1978 | Dittmar | 84/1.01 |
| 4,129,055 | 12/1978 | Whittington et al. | 84/1.01 |
| 4,176,577 | 12/1979 | Yamada et al. | 84/1.01 |
| 4,215,618 | 8/1980 | Kamikawa | 84/1.24 |

OTHER PUBLICATIONS

Thomas E. Oberheim, A Programmer for Voltage Controlled Synthesizers, Nov. 1, 1976, Preprint No. 1172 (E-3).

*Primary Examiner*—Stanley J. Witkowski

*Attorney, Agent, or Firm*—Ronald J. Kransdorf; Jack Kail

[57] ABSTRACT

A programmable electronic musical synthesizer includes a memory controlling a plurality of parameter circuits according to a selected group of stored parameter signals for producing a desired timbre of sound. A memory override system is responsive to manual operation of each of a plurality of control knobs for overriding a corresponding stored parameter signal and coupling an externally derived input signal to the associated parameter circuit. The memory override system thereby conveniently enables one or more selected parameter circuits of the synthesizer to be manually controlled by a performer while the other parameter circuits are simultaneously controlled from memory.

19 Claims, 15 Drawing Figures

NOTES 1.) THE LAST 4 WAVEFORMS INITIALLY OCCUR ON CYCLE FOLLOWING ELC PULSE.

2.) MUX ADDRESS 32 CORRESPONDS TO MOVED FRONT PANEL CONTROL.

MEMORY OVERRIDE SYSTEM FOR PROGRAMMED ELECTRONIC SYNTHESIZER

BACKGROUND OF THE INVENTION

This invention relates to programmable electronic musical synthesizers and more particularly, to improved circuitry for automatically overriding a programmed parameter signal in favor of a manually operated synthesizer control function.

Electronic musical synthesizers are valued by musicians for their ability to create different qualities or timbres of sound. Whereas a piano or trumpet can create only a single characteristic timbre of sound and an organ can create at most a few dozen different timbres of sound, a typical synthesizer can create thousands of different timbres. In this specification and claims, timbre means the quality or characteristic of a sound. The quality or characteristic may be controlled by various sound parameters, such as, for example, loudness, octave, waveshape and harmonic spectrum.

Electronic musical synthesizers have been reduced in size and cost dramatically over the past decade. As a result, they are being used in live performances to a greater extent than ever before. This use of synthesizers has created a need for improved means for conveniently and accurately altering the vast number of different sound timbres which a synthesizer can create.

In order to generate a specific sound on a typical synthesizer, the performer must carefully set the position of many control knobs. There may be 40 to 100 such control knobs that require individual manipulation in order to achieve the the desired timbre of sound. During a live performance, the performer may want to change the timbre of the sound from one section of a composition to another. Typically, such a transition must be achieved in less than one second. Obviously, the transition cannot be made if a large number of control knobs must be repositioned.

In order to overcome the foregoing limitation of synthesizers, there have been attempts to fabricate programming circuits capable of storing the positions of the control knobs and automatically recalling the stored information in order to produce a desired timbre of sound. One such programming circuit is described by Thomas E. Oberheim in published Preprint No. 1172 (E3) entitled "A Programmer for Voltage-Controlled Synthesizers" which was presented to the Audio Engineering Society at its 55th convention, Oct. 29–Nov. 1, 1976. Although the Oberheim programming circuit provides a means of rapidly changing from one programmed timbre of sound to another, it does not provide means for conveniently altering stored information in response to manual operation of the synthesizer control knobs. That is, after recalling the stored information necessary to produce a selected timbre of sound, it would be desirable to provide suitable means for conveniently enabling the performer to manually operate one or more of the synthesizer control knobs to vary the associated sound parameters while otherwise operating the synthesizer in response to stored information.

U.S. Patent Application Ser. No. 921,786, filed July 3, 1978 in the names of David A. Luce and James L. Scott abandoned in favor of continuation application Ser. No. 152,431 filed May 22, 1980 and assigned to the assignee of the present invention, which application is incorporated herein by reference, discloses various "editing" circuits useful in association with a programmable synthesizer. According to this application, each sound parameter contributing to the programmed sound may be manually adjusted by operating a respective control knob, but only after an edit switch associated with the control knob has first been activated. The necessity for operating these edit switches, while not an overly burdensome limitation when used off-stage to edit a programmed timbre of sound, becomes quite objectionable when attempting to quickly override selected parameters of the programmed sound during a live, on-stage performance.

SUMMARY OF THE INVENTION

It is therefore a basic object of the present invention to provide an electronic musical synthesizer capable of conveniently altering a programmed sound during a live, on-stage performance.

It is a more particular object of the invention to provide a memory override system useful in connection with a programmable electronic musical synthesizer for automatically overriding stored parameter signals in favor of input signals associated with control knobs manually operated by a performer.

It is a further object of the invention to provide a memory override system of the foregoing type in which an override operation may be initiated by a performer simply by moving an input signal generating control knob from an initial position to a new position.

In accordance with these and other useful objects, a programmable electronic musical synthesizer according to the present invention includes a plurality of parameter circuits each operable in response to a respective stored parameter signal for producing a programmed timbre of sound. The synthesizer further includes a front panel or the like having a plurality of manually operable control knobs each operating a voltage producing signal source for developing a control signal adapted for suitably controlling a respective one of the synthesizer parameter circuits. Upon initiating operation of the synthesizer, a memory override system samples and stores the values of each control signal, which values correspond to the initial settings of the associated control knobs. Subsequently, each stored control signal value is compared to the current value of the corresponding signal source generated control signal, a non-equality comparison indicating the movement of the associated control knob from its initial setting. By-pass means are activated in response to each non-equality comparison for directly coupling the control signal associated with the moved control knob to its respective parameter circuit in lieu of the corresponding programmed parameter signal. In this manner, each programmed parameter signal may be overriden in favor of the corresponding manually adjustable control signal by simply moving the associated control knob from its initial setting to a new setting. The programmed timbre of sound is thereby altered to reflect the change resulting from operating the parameter circuit in response to the control signal associated with the new setting of the control knob in lieu of the corresponding programmed parameter signal. Means are are also provided for presenting an observable indication to the performer of the relative values between the control signal associated with the last moved control knob and the corresponding programmed parameter signal.

DESCRIPTION OF THE PREFERRED EMBODIMENT

Figure 1:
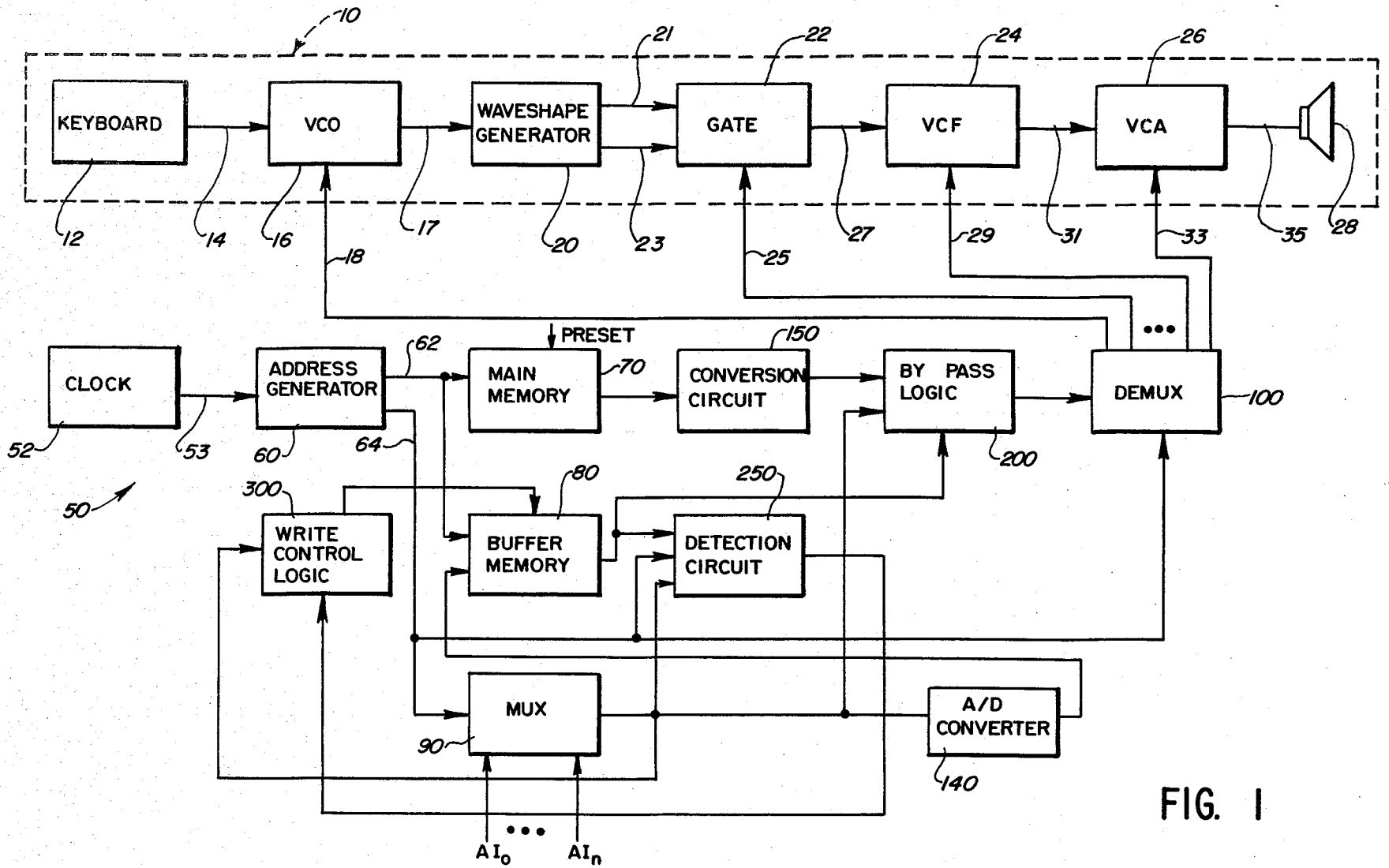
FIG. 1 is a block diagram of a portion of an electronic synthesizer embodying the present invention.

Referring to FIG. 1, the present invention may be used in connection with any electronic musical synthesizer having parameter circuits capable of producing variable timbres of sound which are operated by either analog or digital control signals. One exemplary musical synthesizer 10 having four such parameter circuits is illustrated in FIG. 1. The synthesizer includes a piano-type keyboard 12 which transmits signals indicating the key depressed over a keyboard bus 14 to a voltage-controlled oscillator (VCO) 16. The key depressed determines the pitch of the note desired to be sounded by a performer via VCO 16. VCO 16, in response to the key depressed signal on bus 14 and to an analog pitch transpose signal developed on a conductor 18, generates a signal on an output conductor 17 having a repetition rate representing the note name of the depressed key in an octave determined by the pitch transpose signal. The signal on conductor 17 is used as an input to a conventional waveshape generator 20. A sawtooth waveshape signal is generated on a conductor 21 and a rectangular signal is generated on a conductor 23. Both conductors 21 and 23 form inputs to a conventional analog gate 22. By varying the logic state on a conductor 25, either the sawtooth or rectangular waveshapes are transmitted through the gate to an output conductor 27. As a result, the waveshape parameter can be controlled by the gate.

The selected waveshape on conductor 27 provides an input to a voltage-controlled filter (VCF) 24. By varying the analog voltage on a conductor 29, VCF 24 is able to vary the harmonic content or spectrum of the shaped input signals in order to create tone signals on a conductor 31 which correspond to the desired tone. The tone signals developed on conductor 31 are coupled to a voltage-controlled amplifier (VCA) 26 operated in response to control signals supplied on a conductor 33 for controlling the amplitude of the tone signals. The amplified tone signals are then transmitted via a conductor 35 to a conventional audio output system 28 including a transducer for creating sound waves corresponding to the tone signals.

Circuits 16, 20, 24 and 26 are exemplary of parameter circuits capable of synthesizing different timbres of sound defined by a set of parameters. By varying the values of the control signals supplied to the parameter circuits on conductors 18, 25, 29 and 33, sounds with different timbres can be selectively produced. In a typical commercial synthesizer, more parameter circuits are normally included. However, circuits 16, 20, 24 and 26 are sufficient to teach a person of ordinary skill in the art how to use the present invention in such a commercial synthesizer.

With further reference to FIG. 1, a preferred form of memory override system for use in connection with the exemplary parameter circuits is shown at 50. The system, which operates on a time multiplexed basis, basically comprises a clock 52 supplying an addressing and timing generator 60 over a conductor 53. Generator 60, in turn, develops suitable address signals on busses 62 and 64 for controlling the operation of a main memory module 70, a buffer memory module 80, an input multiplexer 90 and an output demultiplexer 100. The output of main memory module 70 is coupled via a digital to analog conversion circuit 150 to the first input of a by-pass logic circuit 200, a second input to by-pass logic circuit 200 being derived from the output of multiplexer 90. A detection circuit 250, responsive to inputs from buffer memory module 80 and multiplexer 90, as well as to address signals developed on bus 64, cooperates with a write control logic circuit 300 for controlling the operation of buffer memory module 80. The output of multiplexer 90 is also coupled through an analog to digital converter 140 to the data input of buffer memory module 80.

Input multiplexer 90 is shown as having a plurality of inputs $AI_0$–$AI_n$ corresponding in number to the programmable parameter circuits characterizing synthesizer 10 as well as to the number of outputs of demultiplexer 100. Each input $AI_0$–$AI_n$ represents a performer adjustable control panel function for controlling the operation of one of the programmable parameter circuits of synthesizer 10. For example, input $AI_0$ may comprise an analog signal derived from a suitable control panel potentiometer for controlling the transposition of VCO 16 by causing appropriate control signals to be developed on conductor 18. In a similar fashion, another multiplexer input signal may control the operation of gate 22, and so on. Thus, one individual input signal $AI_0$–$AI_n$ is provided from the synthesizer control panel capable of effecting the operation of each programmable parameter circuit of synthesizer 10.

Figure 2:
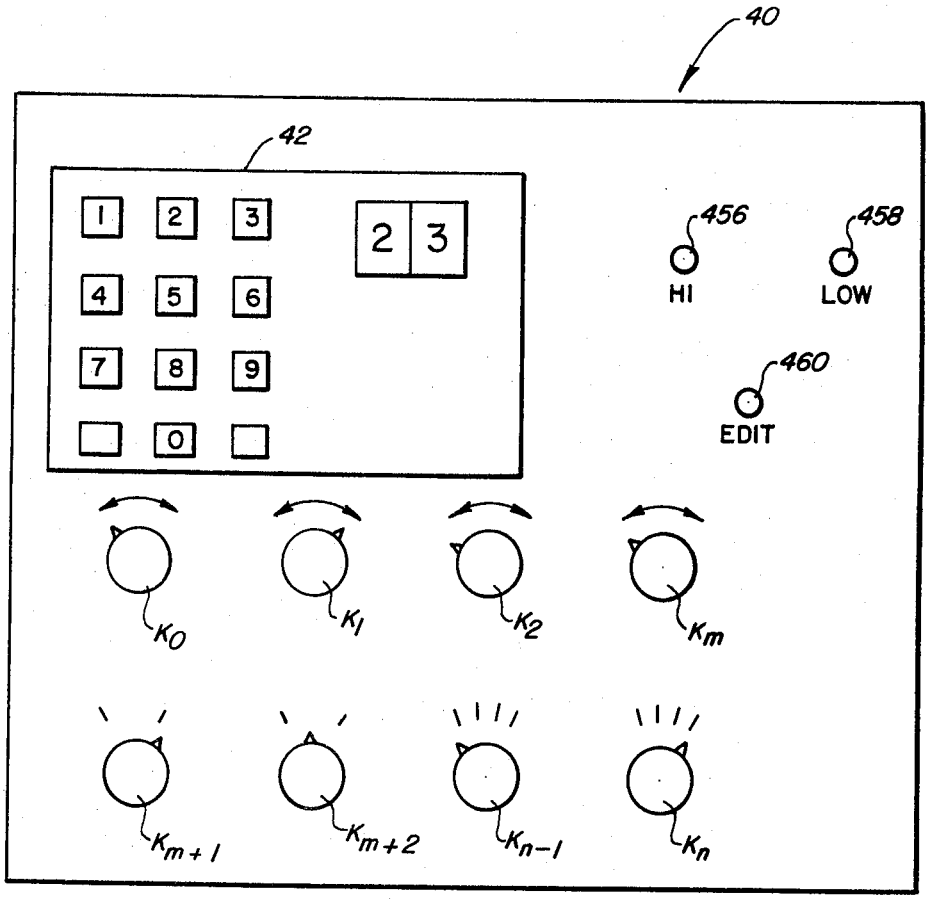
FIG. 2 partially illustrates a synthesizer control panel useful in association with the memory override system of the invention.

An exemplary control panel suitable for use in association with synthesizer 10 is illustrated at 40 in FIG. 2. It will be seen that control panel 40 includes a plurality of control knobs $K_0$–$K_n$ each operating a suitable voltage generating means such as potentiometer, a voltage divider network, or the like, for producing one of the input control signals $AI_0$–$AI_n$. Thus, operation of control knob $K_0$ varies the value of input signal $AI_0$, $K_1$ varies the value of input signal $AI_1$, and so on. As will be explained in further detail, the signals $AI_0$–$AI_n$ developed in response to the operation of control knobs $K_0$–$K_n$, are scanned by multiplexer 90 and may be coupled by demultiplexer 100 to the respective control conductors of the various parameter circuits for controlling the sound produced by synthesizer 10.

The input signals $AI_0$–$AI_n$ may take various forms. The signals may comprise, for example, continuously adjustable analog signals developed by suitably biased potentiometers. Control knobs $K_0$–$K_m$ of FIG. 2 represent means for producing input signals of this type. As illustrated by two-position control knobs $K_{m+1}$ and $K_{m+2}$, the input signals may also be binary in form such as would result from the operation of a flip-flop circuit or the like. Control knobs $K_{n-1}$ and $K_n$ are characterized by four switchable positions each representing a different quantized voltage level. The latter control knobs would be useful for developing input signals for controlling a parameter circuit having four modes of operation. It will be appreciated that the exact number and type of control knobs and associated parameter circuits discussed herein are to be considered exemplary only and not to comprise a limitation on the invention.

A general description of the operation of memory override system 50 will now be provided in connection with FIGS. 1 and 2. Main memory module 70 is designed to store a plurality of different groups of parameter signals, each group representing a different timbre of sound. In the preferred embodiment of the invention, each group consists of 512 bits of memory forming 64 memory words. Each stored memory word is adapted for controlling the operation of a respective one of the parameter circuits of synthesizer 10; the first memory word controlling the parameter circuit associated with control knob $K_0$ and input signal $AI_0$, the second memory word controlling the parameter circuit associated with control knob $K_1$ and input signal $AI_1$, and so on. Thus, each parameter circuit has associated therewith a control knob $K_0$–$K_{63}$, an input signal $AI_0$–$AI_{63}$ and a memory word in each group of parameter signals stored in main memory 70. As will be explained below, each of the 64 parameter circuits may be operated in response to either an associated stored memory word or a control knob and its respective input signal.

The performer may select a desired programmed timbre of sound to be produced by suitably accessing the corresponding group of stored parameter signals. Selection of a desired groupo of stored parameter signals is made through the preset input of main memory module 70, which input may be derived from a data entry keyboard 42 located on the instrument control panel 40. Keyboard 42, a suitable embodiment of which is fully disclosed in the previously mentioned copending application Ser. No. 921,786, comprises key switches 0–9 operating an encoder for developing a binary coded decimal (BCD) output representing the depressed keys. Thus, a selected group of parameter signals, e.g. group 23, may be accessed or recalled by depressing the appropriate keys whereby the corresponding BCD code is coupled to the preset input of main memory module 70.

Buffer memory module 80 comprises a random access memory (RAM) designed to store a single group of parameter signals, i.e. 512 bits. As in the case of main memory module 70, the 512 bits of memory characterizing buffer memory 80 represent 64 memory words, the initial bit of each memory word stored in the buffer memory comprising a flag bit, whose purpose will be described in further detail hereinafter.

Upon activation of system 50, clock 52 and generator 60 cooperate for developing continuously recycling address signals on busses 62 and 64 for sequentially addressing or scanning the preselected group of parameter signals stored in main memory module 70 in synchronism with the corresponding memory locations of buffer memory module 80. At the same time, multiplexer 90 is caused to synchronously scan or address the corresponding control panel input signals $AI_0$–$AI_{63}$ while demultiplexer 100 scans the associated parameter circuits. Thus, when multiplexer 90 is scanning or addressing, for example, the control panel input signal representing the analog signal developed on conductor 18, the corresponding parameter signal stored in main memory module 70 is also being addressed. In addition, the corresponding memory locations of buffer memory 70 are being simultaneously addressed as are the outputs of demultiplexer 100. In this manner, the entire system is operated synchronously in a time multiplexed mode.

During the initial scan by generator 60, i.e. the initial scan after recalling a selected group of parameter signals, write control logic 300 is operative for enabling buffer memory module 80 for storing the control panel input signals $AI_0$–$AI_{63}$ sequentially developed at the output of multiplexer 90 and coupled through analog to digital converter 140 to the data input of the buffer memory. The control panel input signals representing the initial settings of the associated control knobs $K_0$–$K_{63}$ are thereby stored in buffer memory 80 as 64 memory words with all flag bits initialized to a 0 value. It will be appreciated that, due to the synchronous scanning of system 50, the data read into and stored in buffer memory 80 now corresponds, in terms of memory locations, to the data stored in main memory 70. That is, the first word stored in buffer memory 80 representing the initially scanned input signal $AI_0$ associated with control knob $K_0$, occupies the same memory locations of buffer memory 80 as occupied by the word stored in main memory 70 for controlling the parameter circuit of synthesizer 10 also associated with control knob $K_0$. A similar correspondence exists between the remaining 63 words stored in buffer memory 80 and main memory 70.

During the second and all subsequent scans of system 50, buffer memory module 80 is operated such that its output, together with the output of multiplexer 90, are coupled on a time multiplexed basis to the input of detection circuit 250. Detection circuit 250 continuously compares the data stored in buffer memory module 80 (representing the initial settings of control knobs $K_0$–$K_{63}$) with the corresponding multiplexer input signals $AI_0$–$AI_{63}$ and detects any difference therebetween. Detection circuit 250 is therefore operative for detecting the movement of any control panel knob $K_0$–$K_{63}$, which movement is manifested by a change in the value of its associated input signal $AI_0$–$AI_{63}$.

Upon detection of a moved front panel control knob $K_0$–$K_{63}$, detection circuit 250, in cooperation with write control logic 300, causes the flag bit of the associated memory word stored in buffer memory module 80 to assume a logical 1 value. At the same time, the contents of the buffer memory module 80 are updated to reflect the new value of the input signal corresponding to the moved front panel control knob.

By-pass logic circuit 200 is operable for coupling either the parameter signal stored in main memory module 70 or the corresponding control panel input signal developed at the output of multiplexer 90 to demultiplexer 100 for controlling the parameter circuits of synthesizer 10. The intelligence determining which of these two signals are to be coupled by by-pass logic circuit 200 is represented by the contents of the flag bits associated with the data stored in buffer memory 80. A parameter signal stored in main memory module 70 corresponding to a buffer memory word characterized by a 0 value flag bit is coupled directly through conversion circuit 150, by-pass logic 200 and demultiplexer 100 to the appropriate parameter circuit for controlling the operation thereof. However, the presentation of a buffer memory word having an associated 1 value flag bit to by-pass logic circuit 200, results in the coupling of the corresponding control panel input signal $AI_0$–$AI_{63}$ through multiplexer 90, by-pass logic circuit 200 and demultiplexer 100 for controlling operation of the corresponding parameter circuit. In this manner, the parameter circuits of synthesizer 10 are initially controlled by the parameter signals stored in main memory module 70; however, the movement of any front panel control knob $K_0$–$K_{63}$ by the performer automatically overrides the memory system such that the corresponding parameter circuit is operated in response to the control panel input signal associated with the moved front panel control. Of course, the remaining parameter circuits are still controlled in response to parameter signals stored in main memory module 70.

By way of example, assume that a performer wishes to recall a particular group of parameter signals for enabling synthesizer 10 to produce a desired timbre of sound. The preset input of main memory module 70 is appropriately addressed by keyboard 42 for recalling the desired group of stored parameter signals which are sequentially addressed by generator 60. As long as no front panel controls are moved, the addressed parameter signals stored in main memory module 70 are coupled to the parameter circuits for controlling the operation of the synthesizer. Now, assume the performer wishes to alter the characteristics of, for example, VCF 24 from its programmed value. To do so, the performer moves the front panel control knob associated with the VCF to a position different from its initial position. In response thereto, the stored parameter signal otherwise controlling VCF 24 is overridden and the input signal associated with the control knob controlling the VCF is coupled to multiplexer 90, by-pass logic 200 and demultiplexer 100 to conductor 29 for controlling the VCF. The various parameter circuits of synthesizer 10 except VCF 24 are now being operated in response to stored parameter signals. FCF 24, however, is being operated in response to an input signal derived from the front panel control knob associated with the VCF. It is significant that the foregoing is accomplished automatically and without the need for the performer to operate any additional switches or the like. The performer needs merely move the desired front panel control knob to effect the override of the stored parameter signal.

Figure 3:
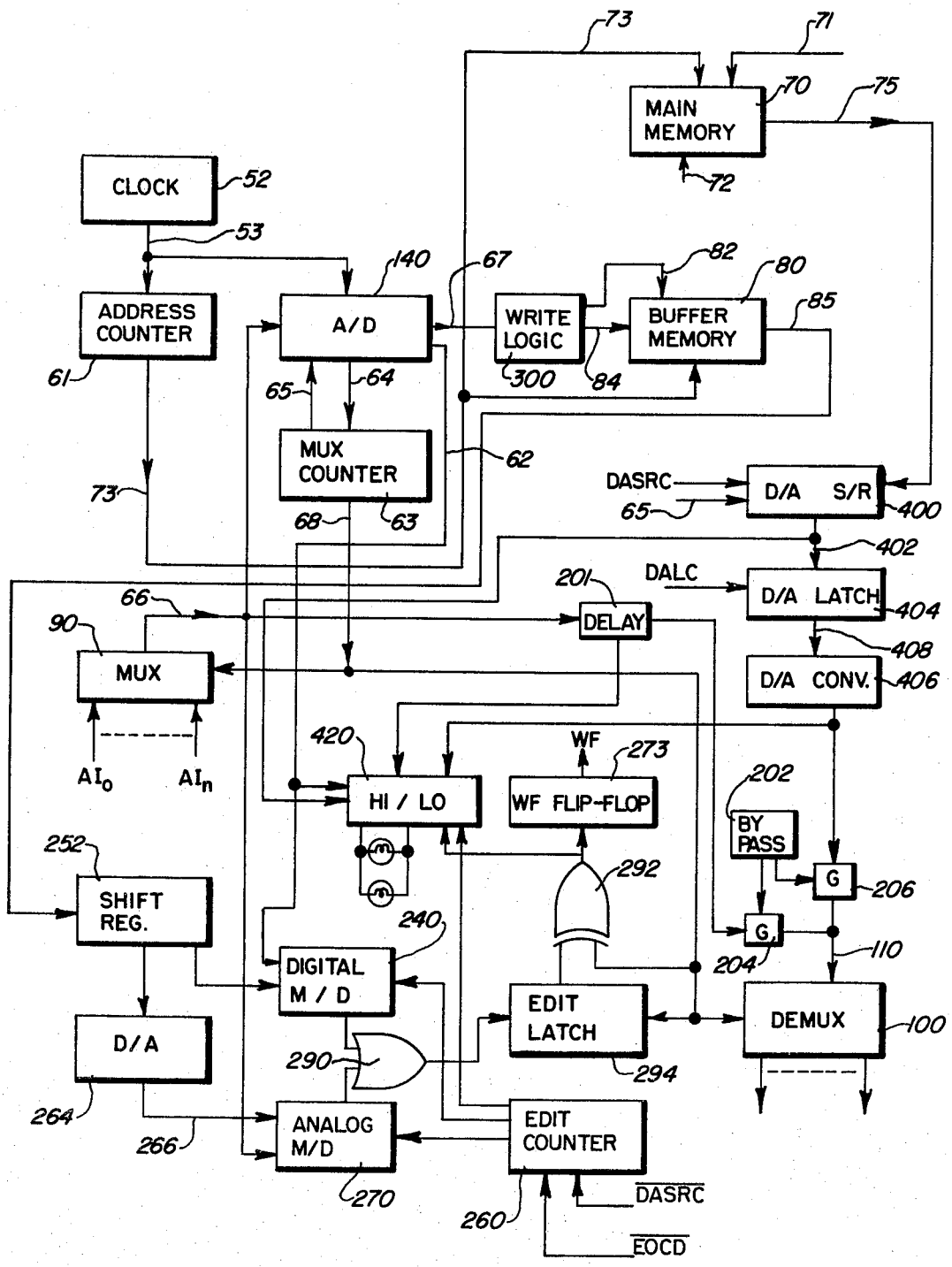
FIG. 3 is a more detailed block diagram illustrating the memory override system of the invention.

Memory override system 50 is shown in more detail in FIG. 3. Main memory module 70 comprises a random access memory (RAM) device organized into a plurality of pages, each page including 8,192 individually addressable binary memory locations. Sixteen different 512 bit stored parameter signal groups are therefore contained on each memory page. Each group of 512 consecutive binary bits is organized such that the first 416 bits define thirty-two 13-bit memory words corresponding to 32 analog controllable parameter circuits. The final 96 memory location bits of each 512 bit group contains thirty-two 3-bit memory words each corresponding to a particular binary controllable parameter circuit. As mentioned previously, the initial bit of each memory word is reserved as a flag bit. Any one of the 512 bit groups can be uniquely addressed by supplying a suitable address signal to the present input of memory module 70 over a line 71 from keyboard 42. Memory module 70 further includes a read/write input 72, a 9-line address bus 73, and a data output line 75. The memory locations within a preselected 512 bit parameter signal group are accessible by providing suitable address signals over address bus 73. Read/write input 72 is connected to a source of logical 1 signal level so that the contents of the memory are continuously developed on output line 75 in bit serial format.

Buffer memory module 80 also comprises a RAM device and includes 512 individually addressable binary memory locations. Thus, buffer RAM 80 includes sufficient memory locations to store a single group of parameter signals. Address bus 73 supplies the address input of buffer RAM 80 which also includes a read/write input 82 receiving a signal BRW, a data input line 84 and a data output line 85. Buffer memory 80 is programmable in accordance with data presented on input line 84 in response to a logically low level signal on read/write input 82 and supplies data to output line 85 in response to a logically high level signal at read/write input 82.

Address signals supplied to address bus 73 are derived from the output of nine-stage binary counter 61. Counter 61 is operable in response to clock pulses from clock 52 for repetitively developing suitable address signals on bus 73 for sequentially addressing all 512 memory locations of a preselected parameter signal group stored in main memory module 70. At the same time, the address signal developed on bus 73 access the corresponding memory locations of buffer memory module 80.

The clock signals developed by clock 52 are also coupled through analog-to-digital converter 140 to the clock input of a multiplexer counter 63 over a conductor 64. Analog-to-digital converter 140 includes a cycle length control input supplied from a conductor 65, a data input supplied from a conductor 66 and a serial data output connected to a conductor 67. Converter 140 also includes a 2-bit parallel output coupled to a two conductor bus 62. Multiplexer counter 63 includes a six conductor output bus 68 addressing multiplexer 90 and demultiplexer 100 for performing repetitive sequential scans of control panel input signals $AI_0$–$AI_{63}$ while simultaneously addressing the associated parameter circuits of synthesizer 10.

Figure 4:
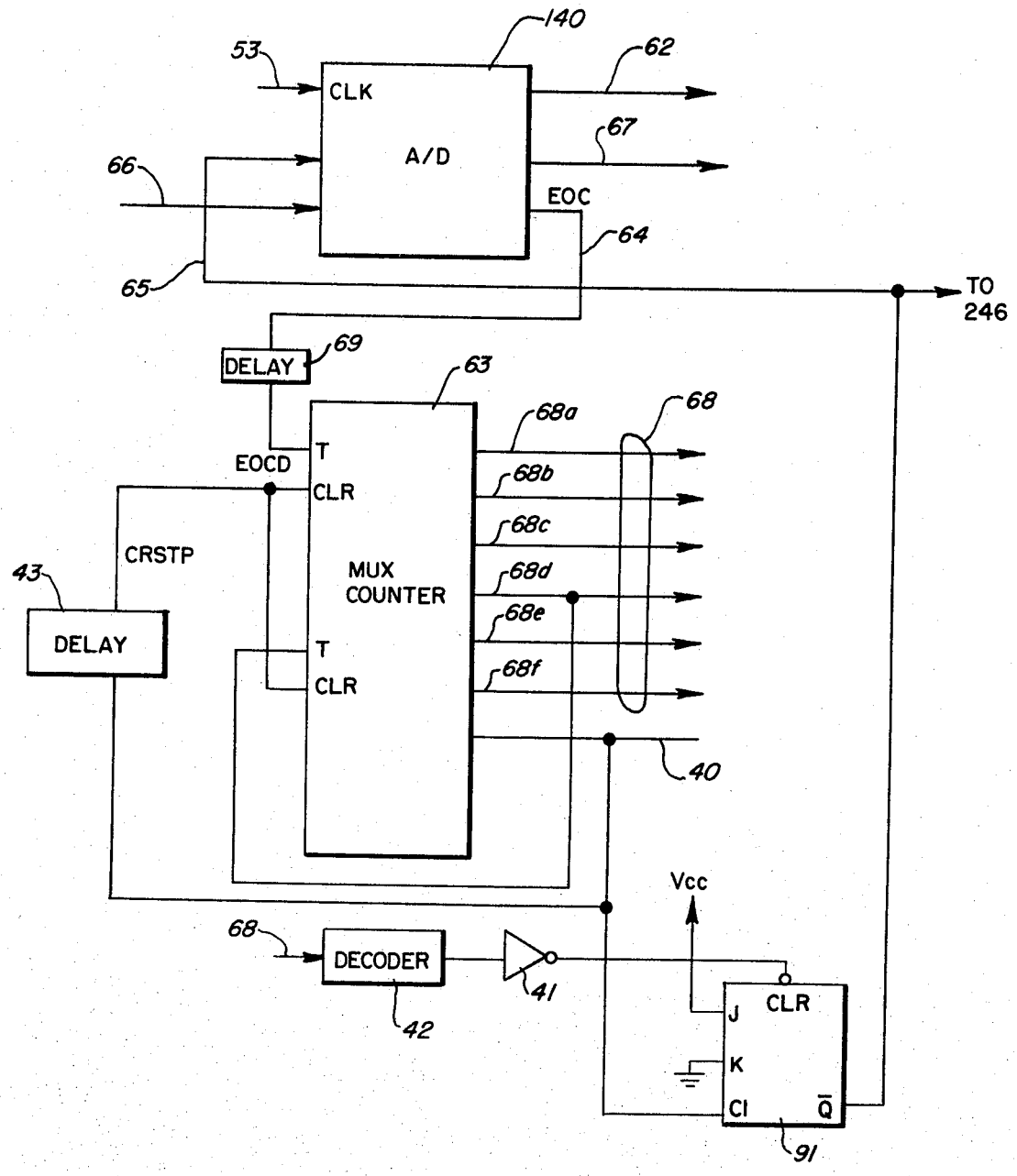
FIG. 4 is a block diagram illustrating the analog-to-digital converter and multiplexer counter shown in FIG. 3.

Analog-to-digital converter 140 and multiplexer counter 63 are shown in more detail in FIG. 4. Analog-to-digital converter 140 is controlled in response to clock pulses from clock 52 and the signal supplied to the cycle length control input by conductor 65. When the signal developed on conductor 65 is logically low, the converter operates in a long cycle conversion mode wherein an analog signal developed on data input conductor 66 is converted to a corresponding bit serial signal on output conductor 67 during an operational cycle comprising 13 clock pulses. Actually, a 13-bit signal is developed on output conductor 67, the last 12 bits of which define the input analog signal. The initial bit of each 13-bit word contains no intelligence at this time. At the end of the conversion cycle, an end of conversion pulse EOC is developed on conductor 64 and coupled through a delay element 69 as a delayed end of conversion pulse EOCD to the toggle input of multiplexer counter 63. The count developed on multiplexer address bus 68, comprising conductors 68*a*–68*f*, is thereby incremented and the next control panel input signal $AI_0$–$AI_{63}$ is coupled to converter 140 over line 66. Upon completion of the intial 32 long mode conversion cycles, a J–K flip-flop 91 is operated for coupling a logically high signal to the mode control input of converter 140 over conductor 65 placing the converter in a short cycle conversion mode.

Flip-flop 91 has its J input connected to a source of positive potential, its K input to a source of ground potential and its clock input to an output conductor 40 of counter 63, conductor 40 developing an output pulse in response to the 64th EOCD pulse supplied to counter 63 during each system scan. Flip-flop 91 is cleared in response to the output of an inverter 41 which is operated by a decoder 42. Decoder 42 is operative for decoding the 33rd EOCD pulse supplied to counter 63 during each system scan.

In the short cycle mode, converter 140 performs a complete conversion cycle every three clock pulses and develops an encoded 3-bit serial signal on output 67 representing the corresponding voltage quantized input signal. The last 2 bits of each signal are also developed in parallel bit format on output bus 62. As in the case of the long cycle conversion mode, the initial bit contains no intelligence, the encoded representation of the input signal being supplied by the last 2 bits of each word. And, as before, a delayed end of conversion pulse EOCD is coupled to the toggle input of multiplexer counter 63 upon the completion of each short conversion cycle. Each delayed end of conversion pulse EOCD clocks counter 63 for incrementing the output developed on address bus 68 so that the next control panel input signal $AI_0$-$AI_{63}$ is interrogated. Upon completion of 32 short mode conversion cycles, flip-flop 91 is set so that its $\overline{Q}$ output equals 0 thereby reestablishing the long mode conversion cycle. Also, a reset pulse CRSTP, derived by delaying the signal on conductor 40 one-half clock cycle by a delay circuit 43 is coupled for clearing counter 63 so that the entire process may be repeated.

Figure 5:
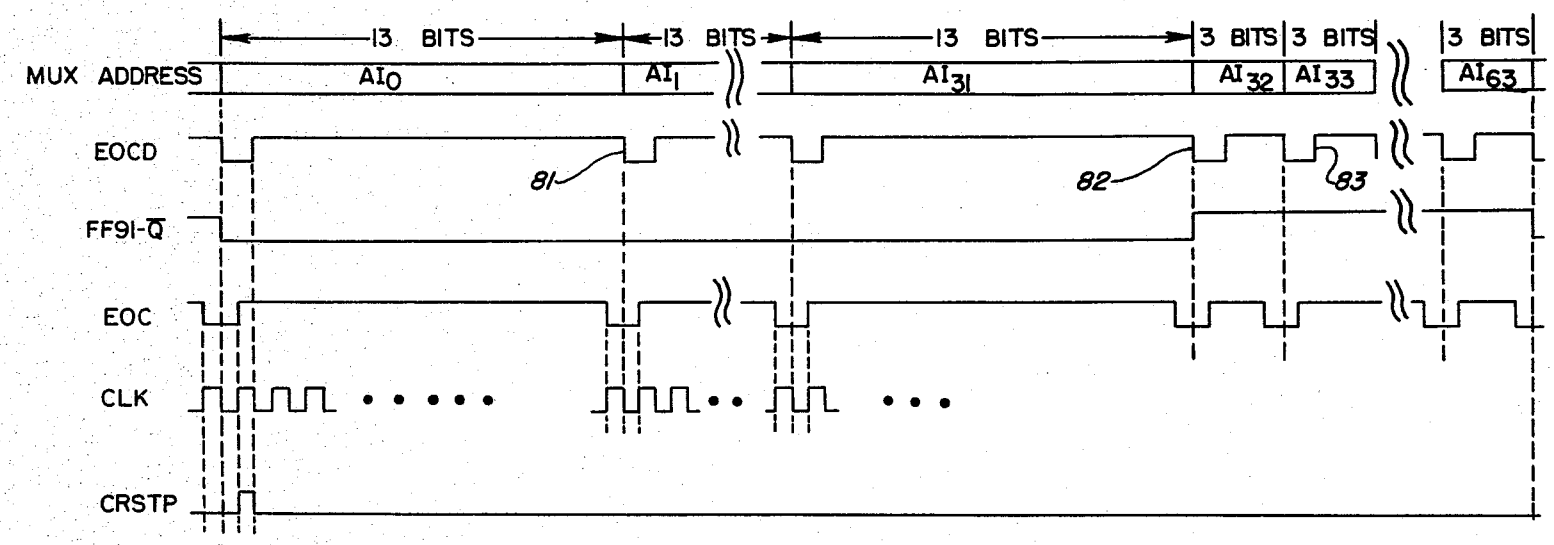
FIG. 5 is a chart showing some of the timing relationships within the circuit illustrated in FIG. 4.

The operation of analog-to-digital converter 140 and multiplexer counter 63 is illustrated in FIG. 5. After the last conversion cycle of the preceding scan of multiplexer inputs $AI_0$–$AI_{63}$, a reset pulse CRSTP resets multiplexer counter 63 to 0 causing the first input signal $AI_0$ to be scanned. Also, flip-flop 91 is set so that its $\overline{Q}$ output is 0 placing converter 140 in the long conversion mode. Consequently, during the next succeeding 13 clock pulses, converter 140 develops a serial 13-bit binary signal on output conductor 67 representing the first input signal $AI_0$. Upon the completion of this conversion cycle, an EOCD pulse 81 is developed incrementing the address signal on bus 68 for enabling the second input signal $AI_1$ to be similarly converted to a serial 13-bit binary signal on output conductor 67. This process continues until the initial 32 input signals $AI_0$–$AI_{31}$ have been successively converted into serial 13-bit binary signals on output conductor 67.

The count developed on bus 68 in response to EOCD pulse 82 is decoded by decoder 42 causing the $\overline{Q}$ output of flip-flop 91 to go high. A high level signal is consequently coupled to the cycle length control input of converter 140 via conductor 65 placing the converter in its short cycle conversion mode. During the next succeeding 3 clock pulses, converter 140 develops an encoded 3-bit serial binary signal on output conductor 67 representing the 33rd input signal $AI_{32}$. Thereafter, the next EOCD pulse 83 increments the address on bus 68 enabling the 34th input signal $AI_{33}$ to be similarly converted to a 3-bit serial binary signal. The process continues until the final 32 input signals $AI_{32}$–$AI_{63}$ have each been successively converted into 3-bit serial binary signals on output conductor 67. At this time, flip-flop 91 is again set and multiplexer counter 63 is cleared, reestablishing converter 140 in the long conversion cycle mode, enabling the entire process to be repeated.

Upon initiating system operation, and during the first scan by generator 60 of memory modules 70 and 80 and multiplexer 90 and demultiplexer 100, read/write input 82 of buffer memory 80 is held logically low by write control logic circuit 300. Also, as will be explained in further detail, during this initial scan, logic circuit 300 is operative for coupling bit serial signals from output 67 of converter 140 to data input 84 of buffer memory module 80. The buffer memory is therefore enabled for writing into memory the 512 bits of serial binary data developed on the output 67 of converter 140. As a result, during the initial system scan, the control panel input signals $AI_0$–$AI_{63}$, representing the initial positions of control knobs $K_0$–$K_{63}$ are read into and stored by buffer RAM 80.

Figure 6:
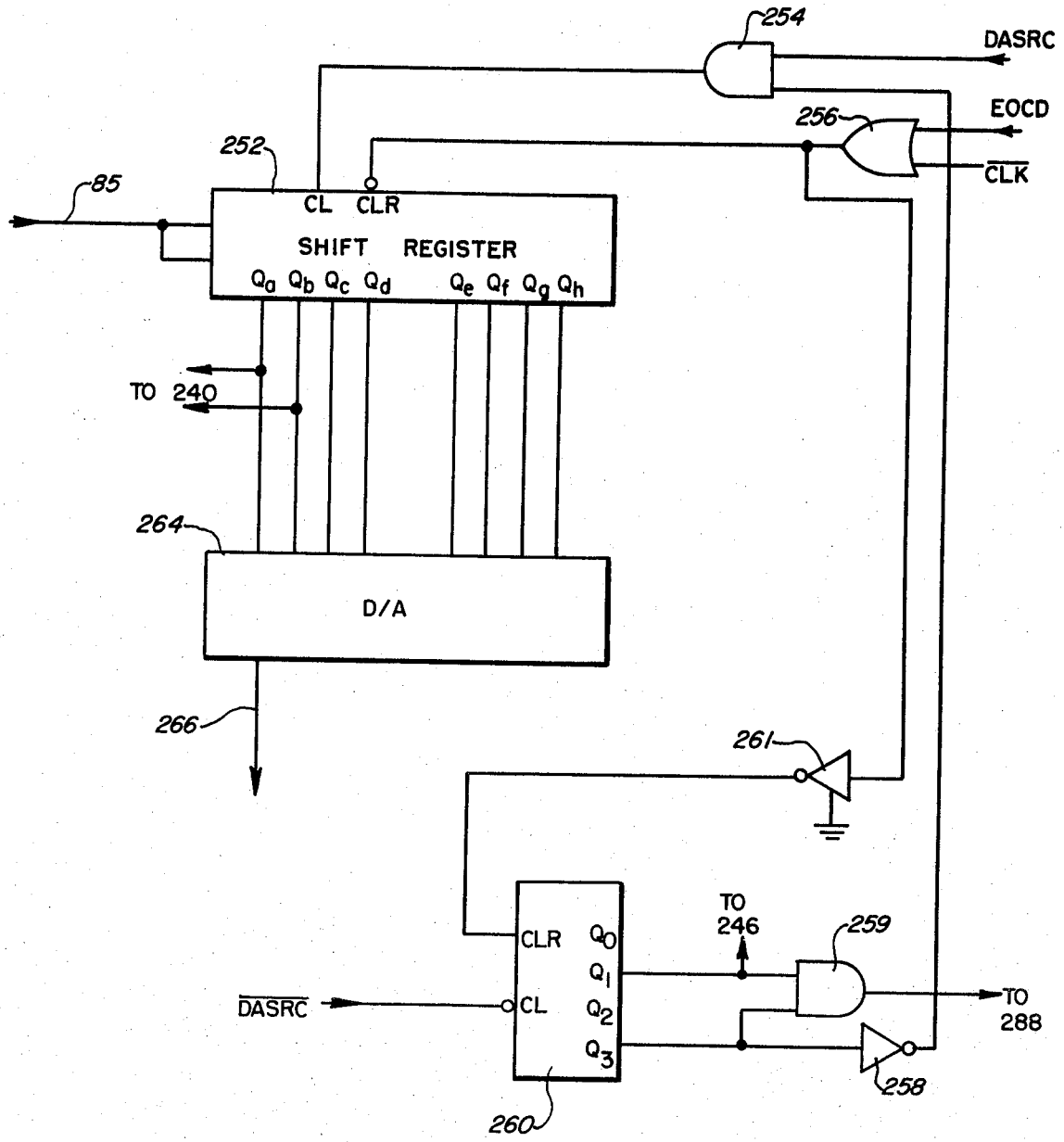
FIG. 6 is a block diagram further illustrating the edit shift register, the buffer digital-to-analog converter and edit counter shown generally in FIG. 3.
Figure 15:
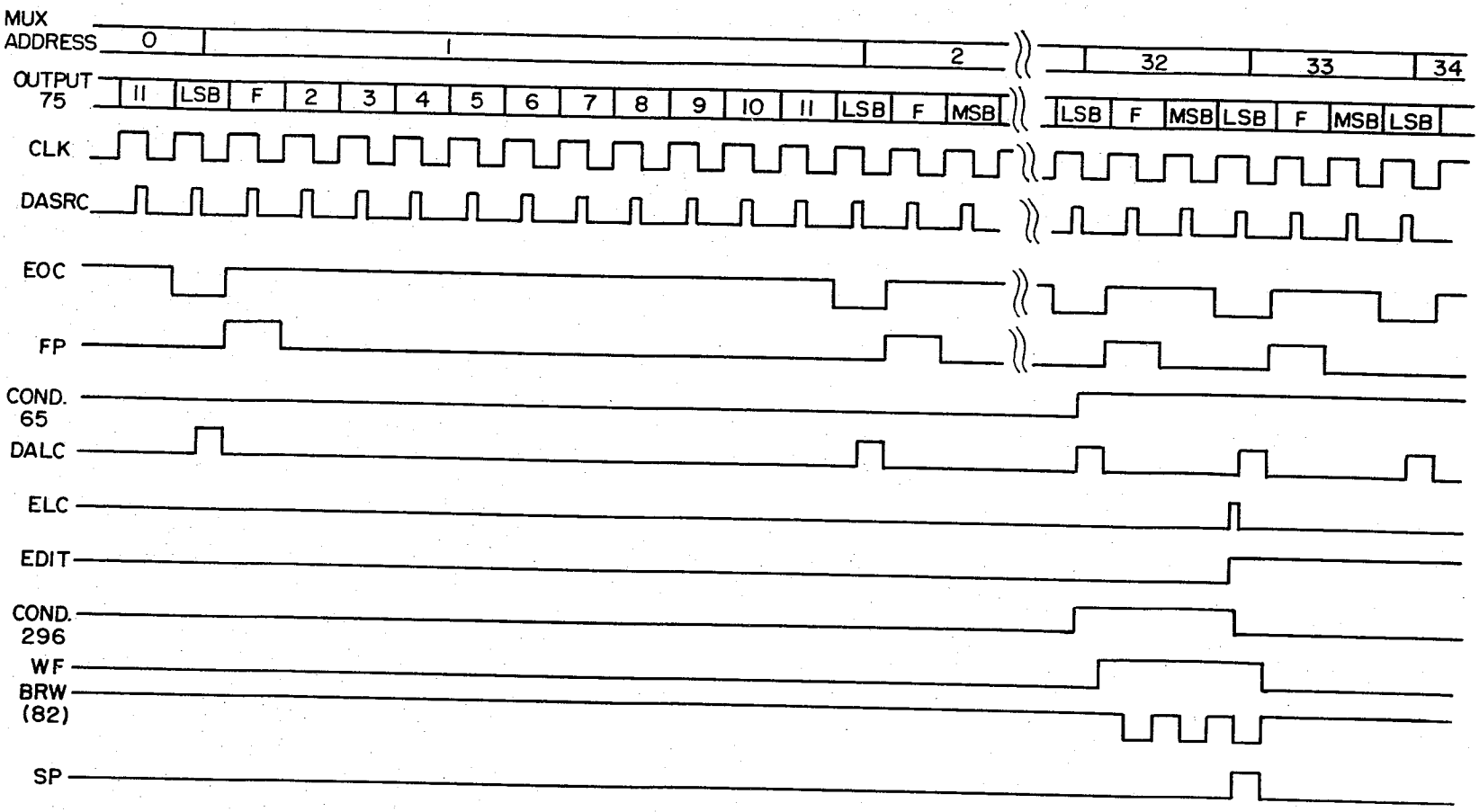
FIG. 15 is a chart showing some of the timing relationships within the circuit of the invention.

During the second system scan, read/write input 82 of memory module 80 goes logically high enabling the memory to serially read data out on conductor 85 in response to signals developed on address bus 73. Referring to FIG. 6, the data read out on conductor 85 is supplied to the input of an eight-stage edit shift register 252. Edit shift register 252 receives a clock input from the output of an AND gate 254 and a clear input from the output of an OR gate 256. AND gate 254 receives one input from clock signal DASRC (see FIG. 15) and a second input from the output of an inverter 258 connected to the $Q_3$ output of a four-stage edit counter 260. Edit counter 260 is clocked by clock signal $\overline{DASRC}$. The output of OR gate 256, which is operated in response to signals EOCD and $\overline{CLK}$, is also connected through an inverter 261 to the clear input of edit counter 260.

At the end of the initial scan cycle (as well as all succeeding cycles), an end of conversion pulse EOCD is coupled through OR gate 256 for clearing edit shift register 252 and edit counter 260. AND gate 254 is enabled by the low signal on the $Q_3$ output of edit counter 260 and therefore applies clock pulses to the clock input of shift register 252. As a consequence, the eight most significant bits of the initial 13-bit control panel representative input signal $AI_0$ developed on buffer memory output line 85 are shifted into the register. After the eighth bit has been shifted into the register, the $Q_3$ output of edit counter 260 goes logically high thereby coupling a logically low signal through inverter 258 for inhibiting AND gate 254. The eight most significant bits representing the initial control panel input signal are therefore loaded into shift register 252.

The data loaded in shift register 252 is coupled from outputs $Q_a$–$Q_h$ to the input of a buffer digital-to-analog converter 264. Buffer digital-to-analog converter 264, in response thereto, develops an analog output signal in the form of a negative going current on a line 266 representing the 8-bit binary word presented by shift register 252.

Figure 7:
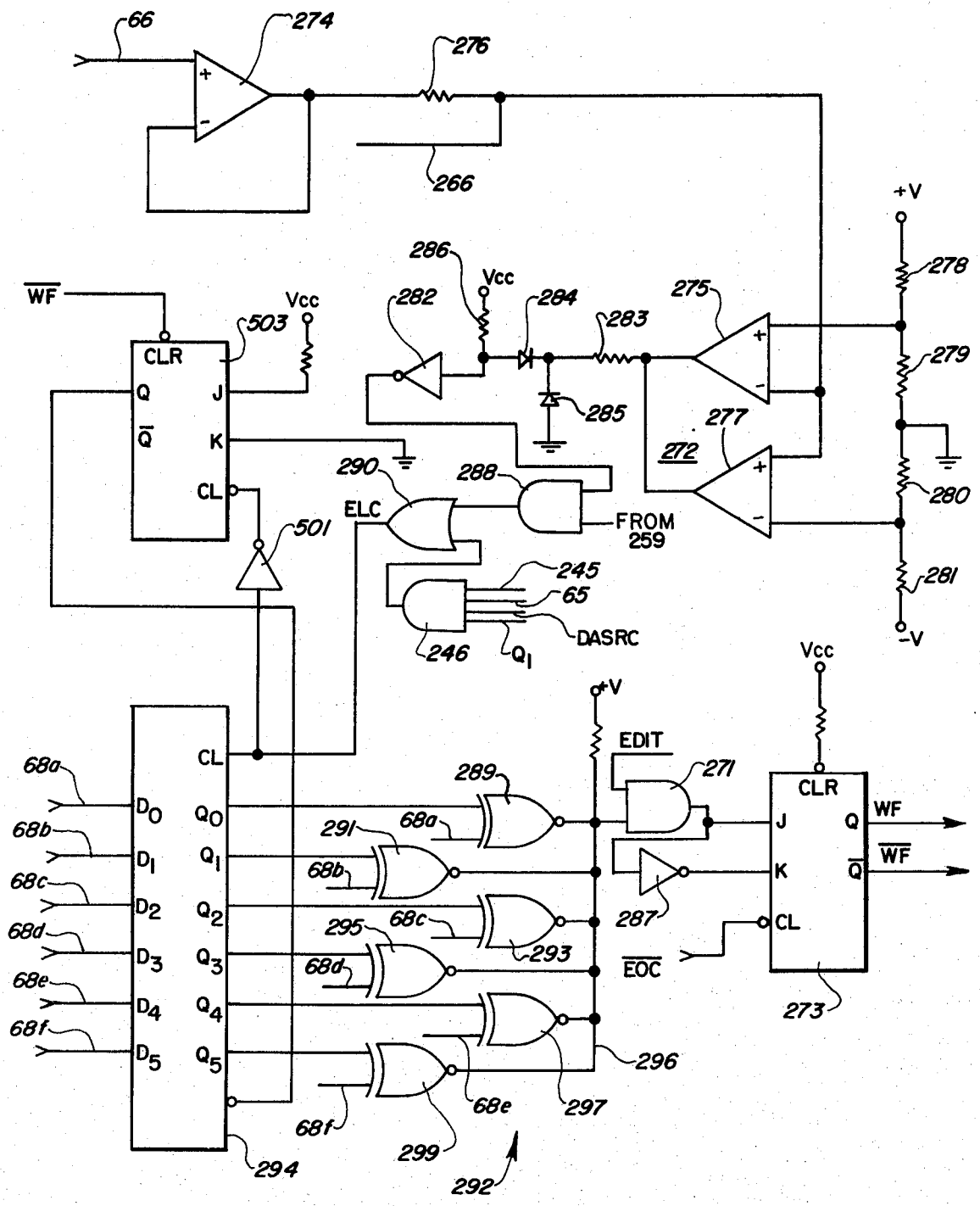
FIG. 7 is a schematic diagram illustrating the analog movement detector and edit latch shown generally in FIG. 3.

Referring to FIG. 7, the signals on line 66 from multiplexer 90 and the current developed at the output of digital-to-analog converter 264 ae compared by a subtracting resistor 276 of an analog movement detector 270, one end of resistor 276 being connected to line 266 amd the other end being connected to line 66 through a buffer amplifier 274. A zero value voltage is coupled to the input of a zero detector circuit 272 from resistor 276 when the signal on line 66 and the current developed at the output of converter 264 are characterized by values representing equivalent analog signals. However, if these values do not represent equivalent analog signals, a non-zero value voltage is coupled to zero detector circuit 272. Such a non-zero value, of course, indicates that the value of one of the control panel input signals $AI_0$–$AI_{63}$ has changed from its value during the initial system scan by operation of the associated control knobs $K_0$–$K_{63}$. Zero detector circuit 272 comprises a pair of operational amplifiers 275 and 277 and associated biasing resistors 278–281 connected between a source of positive and negative potential as shown. The junction between biasing resistors 279 and 280 is connected to a point of ground potential and the junction formed between biasing resistors 280 and 281 is connected to the inverting input of amplifier 277 for supplying a reference potential amplifier 277. A reference potential is applied to the non-inverting input of amplifier 275 from the junction formed between resistors 278 and 279. A non-zero value signal developed by resistor 276 is detected by zero detector 272 which couples a logical 1 level signal through an inverter 282 to the first input of an AND gate 288 in response thereto. A coupling resistor 283, a pair of diodes 284 and 285 and a biasing resistor 286 are connected between zero detector 272 and inverter 282 and serve as a level shifting circuit. The second input to AND gate 288 is supplied from the output of an AND gate 259 (see FIG. 6) which is connected for decoding the tenth and eleventh clock pulses supplied to edit counter 260. Thus, the existence of an inequality condition between the value of an analog signal developed at the output of multiplexer 90 and the signal coupled through converter 264 in response to the corresponding memory word stored in buffer memory 80 results in a logical 1 signal being gated through AND gate 288 during the tenth and eleventh clock pulses supplied to edit counter 260 while the particular analog signal is being addressed.

The output of AND gate 288 is coupled to the first input of an OR gate 290 and therefrom to the clock input of an edit latch 294. The data inputs $D_0$–$D_5$ of edit latch 294 are connected to the six conductors 68*a*–68*f* comprising bus 68 taken from the output of multiplexer counter 63 while the outputs $Q_0$–$Q_5$ of the latch are supplied to the first inputs of a series of EXCLUSIVE OR gates 289, 291, 293, 295, 297 and 299 comprising a coincidence detector 292. The second inputs of the EXCLUSIVE OR gates are derived from the conductors 68*a*–68*f* comprising bus 68. The gates comprising coincidence detector 292 each include an output connected to a conductor 296 which supplies one input of an AND gate 271. The second input of AND gate 271 is supplied with a signal EDIT and the gate's output is connected directly to the J input of a J–K write flag flip-flop 273 and through an inverter 287 to its K input. Signal EDIT, whose derivation will be described later, goes logically high for enabling AND gate 271 in response to movement of any front panel control knob $K_0$–$K_{63}$. Flip-flop 273 is clocked in response to end of conversion pulses $\overline{EOC}$ and produces at its Q output a write flag signal WF.

Assuming that no front panel control knob $K_0$–$K_{63}$ has been moved from its initial setting during the first system scan, the output of OR gate 290 remains low and the circuitry of FIG. 7 is held inactive. Also, signal EDIT is low preventing the setting of flip-flop 273 in response to the development of a spurious signal on conductor 296.

However, upon the detection of a difference in the value between an analog control panel input signal developed on multiplexer output line 66 and the corresponding value of the signal stored in buffer RAM 80 (representing the value of the analog signal during the initial scan by multiplexer 90), a logic signal is coupled from OR gate 290 to the clock input of edit latch 294 causing it to latch the address of the associated front panel control knob $K_0$. In other words, assuming that the first scanned control knob $K_0$ has been moved, the first address developed at the output of multiplexer counter 63 during the system scan is latched in edit latch 294. During the next scan following operation of latch 294, coincidence detector 292 generates a logically high level output on conductor 296 in response to the multiplexer address developed on bus 68 reaching an equality condition with the latched address. Since signal EDIT is logically high now, the signal developed on conductor 296 sets write flag flip-flop 273 in response to the clock signal $\overline{EOC}$ for developing a write flag signal WF at its Q output. As will be explained in further detail, the write flag signal WF developed by flip-flop 273 places buffer memory module 80 in the write mode so that the memory module may be updated to reflect the new value of the input signal $AI_0$ associated with the moved front panel control knob $K_0$, with the updated value being preceded by a logical 1 edit flag. At the end of the 13-bit word frame defining input signal $AI_0$, an end of conversion pulse $\overline{EOC}$ is operative for clearing flip-flop 273 enabling buffer memory 80 to resume its read mode of operation for the succeeding buffer memory words. Thus, the effect of the write flag signal WF is to enable buffer memory module 80 to be updated to reflect the new value of an input signal associated with a moved front panel control knob and to associate the updated value with a logical 1 edit flag. The updating of memory module 80 is necessary to enable any further movement of the once moved front panel control knob to be detected by the system.

The next succeeding thirty-one 13-bit binary words stored in buffer memory module 80 and the corresponding signals developed at the output 66 of multiplexer 90 are similarly compared. That is, each 13-bit word representing the setting of a control panel knob $K_1$–$K_{31}$ during the initial system scan is coupled in turn from buffer memory 80 through edit shift register 252 and buffer digital-to-analog converter 264 to analog movement detector 270. The corresponding input signals $AI_1$–$AI_{31}$ representing the current settings of the associated control knobs $K_1$–$K_{31}$ are similarly coupled by multiplexer 90 to analog movement detector 270. The multiplexer address of any moved control knob $K_1$–$K_{31}$, such movement being manifested by the development of a logical 1 signal at the output of OR gate 290, is latched in edit latch 294. During the next succeeding system scan, coincidence detector 292 develops an output on conductor 296 identifying the latched multiplexer address. The signal developed on conductor 296 results in the development of a write flag signal WF on the Q output of flip-flop 273 framing the multiplexer address of the moved front panel control knob $K_1$–$K_{31}$. If another control knob is subsequently moved, a similar operation is performed with a write flag signal WF being produced at the Q output of flip-flop 273 framing the address of the moved control with latch 294 retaining the multiplexer address of the last moved control. Thus, to summarize, a write flag signal WF is produced framing the multiplexer address of each moved front panel control knob while the address of the last moved control is retained in edit latch 294.

The output of OR gate 290 is also coupled to the clock input of an edit latch lockout flip-flop 503 through an inverter 501. The J input of flip-flop 503 is connected to a source of positive potential while its K input is grounded. the Q output of flip-flop 503 is coupled to the disable input of edit latch 294, the flip-flop being cleared by signal $\overline{WF}$. The basic purpose of flip-flop 503 is to prevent the reloading of latch 294 subsequent to the production of a first clocking pulse at the output of OR gate 290 until the next system scan when an edit flag is written into buffer memory module 80. This is accomplished by clocking flip-flop 503 in response to a first output of OR gate 290 whereby a logical 1 signal is coupled from the flip-flop's Q output to the disable input of latch 294 preventing the latch from being inadvertently reloaded until the next system scan. During the system scan immediately succeeding the clocking of flip-flop 503, a write flag pulse WF is genrated at the Q output of flip-flop 273 in response to coincidence detector 292 detecting a condition of equality between the latched multiplexer address and the current multiplexer address, signal $\overline{WF}$ clearing flip-flop 503 and thereby re-enabling latch 294 for processing any subsequently occurring outputs of OR gate 290. The foregoing is repeated until all moved front panel controls have been processed during succeeding system scans.

Up to this point, only the first thirty-two 13-bit analog representative signals stored in buffer memory module 80 have been considered. The next thirty-two 3 bit binary encoded signals stored in buffer memory module 80 are processed in a corresponding manner. In particular, each of the thirty-two 3-bit encoded words stored in buffer memory module 80 are coupled in serial form over conductor 85 to the input of edit shift register 252 as before. The 3-bit encoded words are shifted into register 252 in response to clock pulses DASRC and the register is cleared after three clock pulses in response to a short mode end of conversion pulse EOCD.

Figure 8:
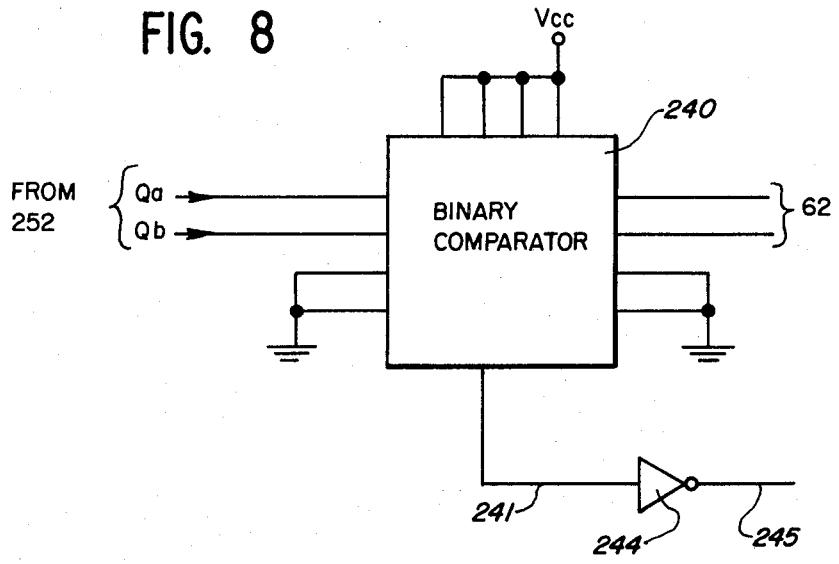
FIG. 8 illustrates the digital movement detector shown generally in FIG. 3.

Referring now to FIG. 8, the two intelligence carrying data bits of each 3-bit buffer memory word are coupled from the $Q_a$ and $Q_b$ outputs of shift register 252 to the first inputs of a digital movement detector 240 comprising a binary comparator. The second inputs of binary comparator 240 are derived from the 2 conductor output bus 62 of analog-to-digital converter 140. The binary data thus presented to the first inputs of the comparator represent the settings of control knobs $K_{32}$–$K_{63}$ during the initial system scan while the binary data presented to the second inputs of the comparator represent the current settings of the control knobs. A logical 1 level signal is developed on output conductor 241 of binary comparator 240 whenever a condition of equality is detected between the binary data present at the two inputs of the comparator.

The output developed on conductor 241 is coupled through an inverter 244 to a conductor 245 which supplies one input of a multiple input AND gate 246 (see FIG. 7). A second input of AND gate 246 is derived from the cycle length control signal developed on conductor 65 (see FIG. 4). It will be recalled that the latter signal is logically high during the short mode conversion status of analog-to-digital converter 140. A third input to AND gate 246 is derived from clock signal DASRC while the final input to the gate is coupled from the $Q_1$ output of edit counter 260. The output of AND gate 246 is coupled through OR gate 290 to the clock input of edit latch 294 and through inverter 501 to the clock input of lockout flip-flop 503.

It will thus be seen that during the short conversion mode status of analog-to-digital converter 140, an inequality condition between the two signals presented to binary comparator 240 (representing the initial and current settings of control panel knobs $K_{32}$–$K_{63}$) results in a logical 1 signal being clocked through AND gate 246 which is enabled during the third clock pulse of each short mode conversion cycle of converter 140. The inequality representative logic signal developed at the output of AND gate 246 is coupled through OR gate 290 to the clock inputs of edit latch 294 and flip-flop 503. In response to the clocking of edit latch 294, coincidence detector 292 and write flag flip-flop 273 cooperate to produce a write flag signal WF as previously described. That is, a write flag signal WF is produced on the Q output of flip-flop 273 framing each 3-bit encoded buffer memory word associated with a moved front panel control knob $K_{32}$–$K_{63}$.

Figure 9:
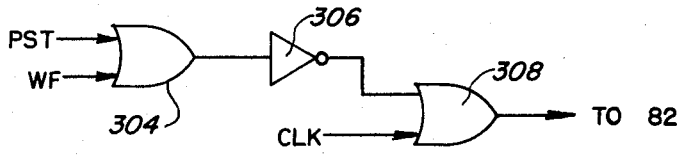
FIGS. 9 and 10 shown in schematic form the write control logic illustrated generally in FIG. 1.
Figure 10:
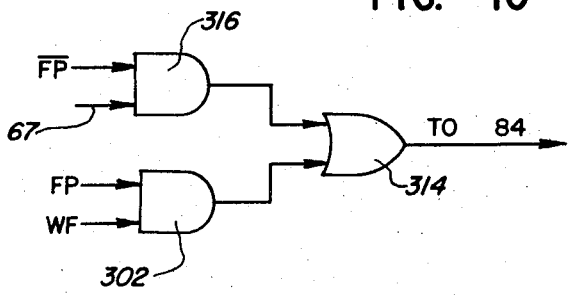

The write flag signal WF identifying the multiplexer address associated with a moved front panel control knob $K_0$–$K_{63}$ is coupled to write control logic 300 illustrated in FIGS. 9 and 10; the basic purpose of logic circuit 300 being to appropriately control read/write input 82 and data input 84 of buffer memory module 80. It will be recalled that a write flag signal WF is developed in response to an inequality condition detected by either analog movement detector 270 or digital movement detector 240.

In FIG. 9, the write flag signal WF is coupled from flip-flop 273 to one input of an OR gate 304. The output of OR gate 304 is coupled through an inverter 306 to one input of a second OR gate 308 whose output is connected to the read/write input 82 of buffer memory 80. The second input of OR gate 308 is connected for receiving clock signal CLK. Upon detection by coincidence detector 292 of a multiplexer address corresponding to a moved front panel control knob $K_0$–$K_{63}$, a write flag signal WF coupled to OR gate 304 results in clock signal CLK being coupled from the output of OR gate 308 to the read/write input 82 of buffer memory module 80. The buffer memory is thereby alternately placed in its read and write modes for the duration of the modified word frame. This enables the buffer memory module 80 to be updated to reflect the value of the control panel input signal $AI_0$–$AI_{63}$ associated with the moved control knob $K_0$–$K_{63}$ while, at the same time, continuing to develop output date on line 85. In this manner, data reflecting the updated memory word stored in buffer memory module 80 is continuously coupled to by-pass logic 200 during subsequent system scans when a write flag signal WF is developed. During unmodified word frames, defined by the absence of a write flag signal WF, the output of OR gate 308 is held logically high so that data is continuously read out of buffer memory module 80 with no updating of its contents being effected.

It will be noted that a signal PST is coupled to the second input of OR gate 304. Signal PST goes logically high for a complete scan cycle upon the selection of an initial main memory module preset or upon the changing of a previously selected preset. In either event, a logical 0 signal is developed at the output of inverter 306 enabling coupling of clock signal CLK to the read/-write input 82 of buffer memory module 80 for the entire associated scan cycle. The buffer memory is thereby again alternately placed in its write and read modes enabling the memory to be completely loaded or reloaded as the case may be from output 67 of analog-to-digital converter 140.

Referring now to FIG. 10, the write flag signal WF is also coupled to one input of an AND gate 302 of write control logic 300. The second input of AND gate 302 is supplied with a signal FP. Signal FP is logically high during the flag data bit time, i.e. the initial bit time, of each memory word and is otherwise low. The output of AND gate 302 is coupled through an OR gate 314 to the data input 84 of buffer memory module 80. Thus, the generation of a write flag signal WF simultaneously places buffer memory module 80 in the write mode and also causes a logical 1 signal to be presented to data input 84 during the flag data bit time. The FP pulse thereby results in the insertion of a logical 1 edit flag in the flag bit position of each modified memory word defined by a write flag signal WF.

With further reference to FIG. 10, a second input to OR gate 314 is derived from the output of an AND gate 316. AND gate 316 is supplied with signal $\overline{FP}$ and the bit serial data output 67 of analog-to-digital converter 140. During the true state of signal $\overline{FP}$, signals developed on output 67 of analog-to-digital converter 140 are therefore coupled to the data input 84 of buffer memory module 80. It will be recalled that the signal developed on the output 67 represents the control panel input signals $AI_0$–$AI_{63}$ coupled by multiplexer 90 over conductor 66 to the input of analog-to-digital converter 140. Since signal $\overline{FP}$ is true at all times except during the flag bit positions of each memory word, the output of analog-to-digital converter 140 is continuously coupled to the data input 84 of buffer memory module 80 except during the initial bit time of each respective word.

Even though data is continuously coupled from analog-to-digital converter 140 to data input 84 of buffer memory module 80, the data is stored in the memory only when the output of inverter 306 is logically low. As previously explained a logically low level signal is developed at the output of inverter 306 during the duration of a modified word frame in response to the coupling of a write flag signal WF to one input of OR gate 304. Also, a logically low signal is developed at the output of inverter 306 for a complete system scan cycle in response to signal PST signifying the operation of recalling a preset from main memory module 70. Thus, the circuits illustrated in FIGS. 9 and 10 cooperate such that, in response to the movement of a front panel control knob $K_0$–$K_{63}$, a write flag signal WF is produced causing a logical 1 edit flag to be inserted in the flag bit position of the associated memory word followed by the updating of the memory word to reflect the new value of the input signal $AI_0$–$AI_{63}$ associated with the moved control knob. Also, upon recalling a preset from main memory module 70, the entire contents of buffer memory module 80 are updated to reflect the current values of the control panel input signals $AI_0$–$AI_{63}$ with all edit flags set to zero (i.e. AND gate 302 is inhibited by the absence of a WF signal).

The intelligence carried by the edit flag associated with each data word stored in buffer memory module 80 is interpreted by by-pass logic 200. As illustrated in FIG. 3, by-pass logic 200 comprises a by-pass decoding circuit 202 operating a pair of transmission gates 204 and 206. Transmission gate 204 has an input connected for receiving the control panel input signals $AI_0$–$AI_{63}$ developed on output conductor 66 of multiplexer 90 through a delay element 201 and an output connected to the data input 110 of demultiplexer 100. Transmission gate 206 has an input connected for receiving the output of main memory module 70 via a digital-to-analog shift register 400, a digital-to-analog latch 404 and a digital-to-analog converter 406. The output of transmission gate 206 is also connected to input 110 of demultiplexer 100. By-pass decoding circuit 202 suitably controls the states of transmission gates 204 and 206 such that, upon the detection of a logical 0 edit flag, only gate 206 is rendered conductive for directly coupling the memory word associated with the edit flag from main memory module 70 to demultiplexer 100. On the other hand, in response to a logical 1 edit flag, only gate 204 is rendered conductive for passing the control panel input signal from the output 66 of multiplexer 90 to demultiplexer 100. It will thus be seen that the association of a logical 1 edit flag with a buffer memory data word effectively results in the by-passing of main memory module 70 in favor of the control panel input signal $AI_0$–$AI_{63}$ corresponding to a moved front panel control knob $K_0$–$K_{63}$.

Figure 11:
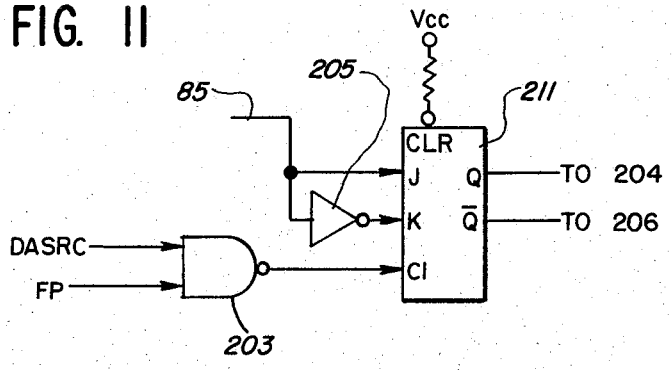
FIG. 11 is a schematic diagram showing the by-pass logic generally illustrated in FIG. 1.

By-pass decoding circuit 202 is shown in more detail in FIG. 11. A J-K flip-flop 211 has its clock input connected to the output of a NAND gate 203, its K input to the output of an inverter 205 and its J input to the output 85 of a buffer memory module 80. NAND gate 203 is operated in response to inputs derived from signal FP and clock signal DASRC while inverter 205 has its input connected to the output of buffer memory module 80 developed on conductor 85. It will be recalled that signal FP frames the edit flag bit position of each memory word stored in buffer memory module 80 so that flip-flop 211 is clocked during the edit flag bit times of each respective memory word. A logical 0 edit flag developed on conductor 85 is simultaneously presented to flip-flop 211 as a logical 0 signal at the flip-flop's J input and as a logical 1 signal at its K input. As a result, the flip-flop is reset and a logical 0 signal is coupled from its Q output to the control terminal of transmission gate 204. At the same time, a logical 1 signal is coupled from the $\overline{Q}$ output of flip-flop 211 to the control terminal of transmission gate 206. Thus, in response to logical 0 edit flag, transmission gate 206 is rendered conductive while gate 204 is rendered nonconductive. Under these conditions, the parameter signal stored in main memory module 70 corresponding to the logical 0 edit flag is coupled through gate 206 to demultiplexer 100 for controlling its associated parameter circuit. A logical 1 edit flag developed on conductor 85 is, on the other hand, presented to flip-flop 211 as a logical 1 signal at the flip-flop's J input and as a logical 0 signal at its K input. The flip-flop is therefore set coupling a logical 1 signal from its Q output to gate 204, rendering the gate conductive, and coupling a logical 0 signal from its $\overline{Q}$ output to gate 206 rendering this gate nonconductive. Under these conditions, gate 204 passes the output of multiplexer 90 associated with the logical 1 edit flag to demultiplexer 100 for controlling the associated parameter circuit and thereby by-passing the corresponding parameter signal stored in main memory module 70.

Referring back to FIG. 3, it will be seen that the binary serial output of main memory module 70 developed on conductor 75 is coupled to gate 206 via a digital-to-analog shift register 400, a digital-to-analog latch 404, and a digital-to-analog converter 406. The primary purpose of the latter mentioned circuitry is to enable the conversion of the serial binary signals developed on conductor 75 to corresponding analog signals suitable for operating the various parameter circuits of the synthesizer.

More specifically, the parameter signals stored in main memory module 70 are continuously coupled in serial format to the input of shift register 400 by conductor 75. Data is shifted into register 400 at the frequency of clock 52 by clock signal DASRC and coupled to a twelve conductor output bus 402. Bus 402 is applied to the input of latch 404 which is operated in response to a signal DALC. Signal DALC occurs during the second half clock period coinciding with the least significant bit of each memory word. Therefore, each memory word corresponding to a programmed parameter signal is, in turn, temporarily stored in latch 404. Register 400 includes a mode control input connected to the $\overline{Q}$ output of flip-flop 91. The signal coupled to the mode control input is logically low during that portion of each system scan in which 13-bit memory words are developed on conductor 75 and is logically high during those portions in which 3-bit memory words are developed on conductor 75. Shift register 400 is thereby appropriately configured for coupling either 12-bit or 2-bit data words to latch 404 depending upon the state of the signal coupled to its mode control input.

The data stored in latch 404 is presented in parallel format to a digital-to-analog converter 406 over a twelve conductor bus 408. Digital-to-analog converter 406 converts each stored memory word representing a programmed parameter signal to a corresponding analog signal which is then coupled to an output conductor 410 for presentation to transmission gate 206. Gate 206 couples the analog signals developed on conductor 410 to demultiplexer 100 for controlling the parameter circuits of synthesizer 10 as previously described herein.

It is desirable that the performer operating memory override system 50 be provided with an observable indication of the relative value between the control panel input signal $AI_0$–$AI_{63}$ associated with the last moved control panel knob $K_0$–$K_{63}$ and the corresponding parameter signal stored in main memory module 70. That is, assuming that the performer has in fact moved a particular front panel control knob $K_0$–$K_{63}$, he would be interested in knowing whether the associated control panel input signal is greater than, less than, or equal to the value of the corresponding parameter signal stored in main memory module 70. As explained below, HI/LO indicator circuit 420 provides such an indication.

Figure 12:
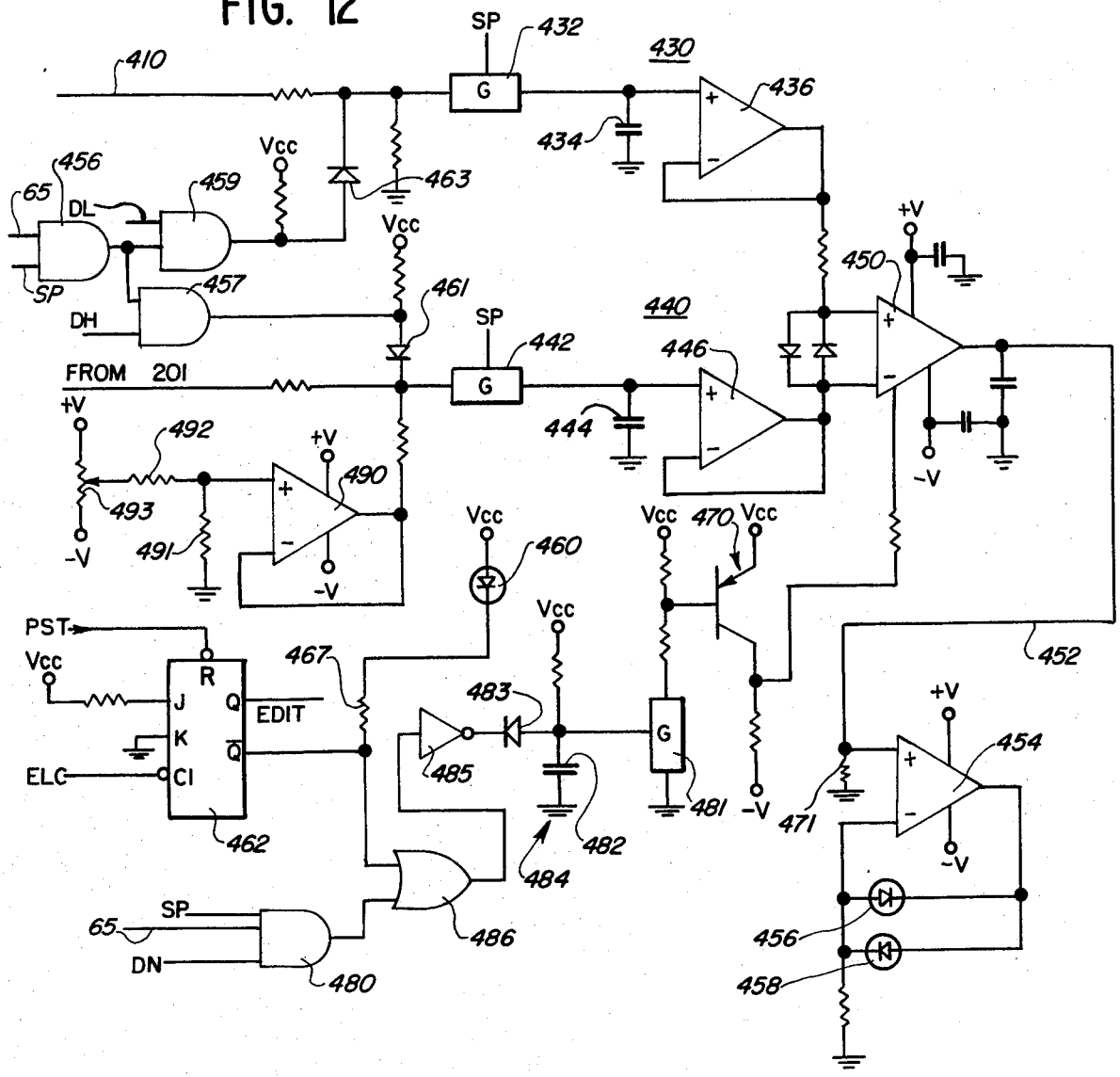
FIGS. 12 and 13 illustrate in schematic form the HI/LO indicator circuit shown generally in FIG. 3.

Referring to FIG. 12, HI/LO indicator circuit 420 comprises a first input connected to output conductor 410 of digital-to-analog converter 406 and a second input connected to the output 66 of multiplexer 90 through delay circuit 201. In order to insure the presentation of corresponding inputs to the circuit illustrated in FIG. 12, delay circuit 201 introduces a one memory word delay to the signal developed on output 66 of multiplexer 90 to compensate for the one memory word delay introduced into the signal developed on conductor 410 by shift register 400. Returning to FIG. 12, the signal developed on conductor 410, representing the output of main memory module 70, is coupled to a first sample and hold circuit 430 comprising a transmission gate 432, a capacitor 434 and a buffer amplifier 436. The input from delay circuit 201 is coupled to a second sample and hold circuit 440 comprising a transmission gate 442, a capacitor 444 and a buffer amplifier 446. Transmission gates 432 and 442 are operated in response to a gating or sampling pulse SP (see FIG. 15) which, in the case of 13-bit data words, coincides with the second most significant bit of the data word following the development of a signal on conductor 296. For 3-bit data words, the sampling pulse SP coincides with the second half of the least significant bit of the data word defined by the signal on conductor 296. Therefore, transmission gate 442 is operated so as to sample the control panel signal $AI_0$–$AI_{63}$ associated with the last moved control panel while transmission gate 432 samples the corresponding parameter signal stored in main memory module 70 as developed on conductor 410.

The sampled signals are coupled to storage capacitors 434 and 444 and therefrom through buffer amplifiers 436 and 446 to the input of an operational transconductance amplifier 450. Amplifier 450, when supplied with a bias current from a transistor 470, produces an output current on a conductor 452 roughly proportional to its input. Thus, if the signals applied to the amplifier's input terminals are equal, a zero value output current is generated. However, if the output of sample and hold circuit 440 exceeds that of sample and hold circuit 430, a negative going current is developed on output conductor 452. On the other hand, if the output of sample and hold circuit 430 exceeds that of sample and hold circuit 440, a positive going current is developed on output conductor 452. The currents developed on conductor 452 are converted to voltage signals by a resistor 471 and coupled through a driver amplifier 454 to a pair of indicator lamps 456 and 458. HI indicator lamp 456 is illuminated in response to a negative going current developed on conductor 452 indicating that the value of the control panel input signal $AI_0$–$AI_{63}$ associated with the last moved control panel knob $K_0$–$K_{63}$ exceeds the value of the corresponding parameter signal stored in main memory module 70. LO indicator lamp 458 is illuminated in response to a positive going current developed on conductor 452 indicating that the value of the control panel input signal $AI_0$–$AI_{63}$ associated with the last moved control panel knob $K_0$–$K_{63}$ is less than the value of the corresponding parameter signal stored in main memory module 70. Should neither lamp 456 nor 458 be illuminated, a condition of equality between the values of the input signal $AI_0$–$AI_{63}$ associated with last moved control panel knob $K_0$–$K_{63}$ and the value of the corresponding parameter signal stored in main memory module 70 is indicated. Operation of indicator lamp 456 and 458 thereby provides the performer with a readily observable manifestation of the relationship between the value of the control panel input signal $AI_0$–$AI_{63}$ associated with the last moved control panel knob $K_0$–$K_{63}$ and the value of the corresponding parameter signal stored in main memory module 70.

The magniture of the difference between the two input signals coupled to amplifier 450 is reflected in the amplitude of the current developed on conductor 452. A large difference results in a current having a relatively high amplitude while a smaller difference results in a current characterized by a smaller amplitude. The amplitude of the current developed on conductor 452 also determines the brilliance with which indicator lamps 456 and 458 are illuminated. Thus, a large difference in input signal values results in the appropriate indicator lamp 456 or 458 being brilliantly illuminated. As the corresponding front panel control knob is operated for equalizing the input signal values, the brilliance with which the indicator lamp is illuminated is gradually reduced until finally the lamp is extinguished in response to reaching a condition of equality. If the control knob is operated further in the same direction, the other indicator lamp will illuminate with its brilliance gradually increasing until a maximum illumination is achieved. This effect provides a convenient means by which a performer is alerted to an approaching equality condition between an input signal associated with a moved front panel control and the corresponding stored parameter signal.

The description of HI/LO indicated circuit 420 set forth above concerned only the operation of lamps 456 and 458 in response to comparisons between the initial thirty-two 13-bit stored parameter signals and their corresponding input signals $AI_0$–$AI_{63}$ respectively. Indicator circuit 420 is also responsive, in a largely similar manner, to comparisons between the final thirty-two 3-bit stored parameter signals and their corresponding input signals $AI_{32}$–$AI_{63}$ respectively. As before, the lamps 456 and 458 are operated in response to the last moved of the control knobs $K_{32}$–$K_{63}$ wherein lamps 456 and 458 are illuminated upon the input signal $AI_{32}$–$AI_{63}$ associated with the last moved control panel knob $K_{32}$–$K_{63}$ being greater than or less than the corresponding 3-bit stored parameter signal stored in main memory module 70. And again, as before, neither lamp 456 nor 458 is illuminated in response to a condition of equality between the respective signals.

Figure 13:
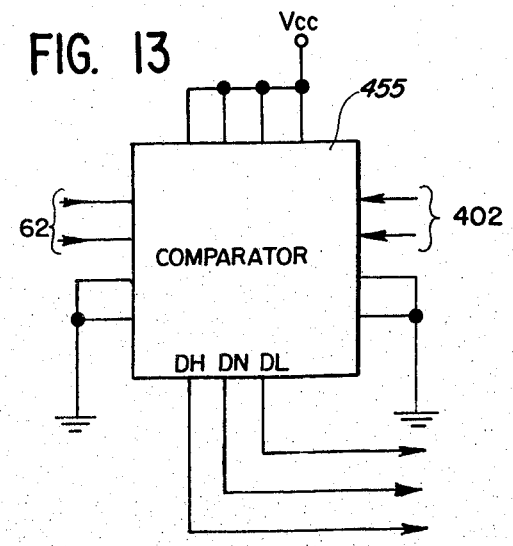

The foregoing is achieved by a means of a binary comparator 455 illustrated in FIG. 13 operating in cooperation with indicator circuit 420. Referring to FIG. 13, comparator 455 includes a first input connected for receiving the 2-bit encoded data developed on output 62 of analog-to-digital converter 140. This data represents the input signals $AI_{32}$–$AI_{63}$ coupled from multiplexer 90 to converter 140 over conductor 66. Binary comparator 455 includes a second input connected for receiving the 2-bit encoded data developed on output 402 of digital-to-analog shift register 400. This data corresponds to the final thirty-two 2-bit parameter signals stored in main memory module 70. Binary comparator 455 in turn compares each 2-bit binary encoded word developed on output 62 with the corresponding 2-bit encoded word developed on output 402. Each of the thirty-two comparisons performed during a system scan results in a logical 1 signal being developed on one of the outputs DH, DN or DL of the comparator. A logical 1 signal developed on output DH or output DL signifies that the 2-bit word developed on output 62 is greater than or less than the corresponding 2-bit word developed on output 402 respectively. A logical 1 signal developed on output DN signifies a condition of equality between the two signals.

Referring back to FIG. 12, outputs DH and DL are coupled to the first inputs of AND gates 457 and 459 respectively. The second inputs of AND gates 457 and 459 are supplied in common from the output of an AND gate 456 whose inputs comprise signal SP and the output 65 of multiplexer counter 63. It will be recalled that the signal developed on output 65 is at a logical 1 level for that portion of each system scan during which the thirty-two 2-bit parameter signals stored in main memory module 70 are being interrogated. Therefore, during coincidence of the signal SP and the signal developed on conductor 65, AND gates 457 and 459 are enabled for coupling outputs DH and DL through steering diodes 461 and 463 to sample and hold circuits 440 and 430 respectively. A logical 1 signal developed on output DH is therefore coupled by sample and hold circuit 440 to the inverting input of amplifier 450. This results in a negative going current being developed on output 452 of the amplifier causing HI lamp 456 to illuminate. Similarly, a logical 1 signal developed on output DL is coupled by sample and hold circuit 430 and diode 463 to the non-inverting input of amplifier 450. This results in a positive going current being produced on output 452 of the amplifier causing LO lamp 458 to illuminate.

With further reference to FIG. 12, an edit lamp 460 is connected to the $\overline{Q}$ output of a flip-flop 462 by a resistor 467. The J input of flip-flop 462 is connected to a source of a logical 1 signal while the flip-flop's K input is connected to a source of a logical 0 signal. The flip-flop is clocked in response to the development of an edit latch clock pulse ELC at the output of OR gate 290 and is cleared in response to a clear edit latch pulse CEL. It will be recalled that an edit latch clock pulse ELC is produced in response to the movement of a front panel control knob $K_0$–$K_{63}$. Thus, such movement results in setting flip-flop 462 which produces a logical 0 signal at its $\overline{Q}$ output. The logical 0 signal at the $\overline{Q}$ output of flip-flop 462 enables the illumination of edit lamp 460 providing an observable manifestation to the performer that one of the stored parameter signals is being overridden by its corresponding input signal so that he is not listening to a pure programmed or preset sound. Edit lamp 460 is deactivated in response to signal PST clearing flip-flop 462 indicating that a purely programmed sound is again being produced.

As mentioned previously, bias current for amplifier 450 is provided by transistor 470. The state of transistor 470 is, in turn, controlled by a lamp enable circuit 484 which includes transmission gate 481 whose control terminal is connected to the junction formed between a capacitor 482 and the anode of a diode 483. The cathode of diode 483 is connected through an inverter 485 to the output of an OR gate 486. One input to OR gate 486 is derived from the $\overline{Q}$ output of flip-flop 462, the second input being connected to the output of a multiple input AND gate 480. The three inputs to AND gate 480 comprise the sampling pulse signal SP, the signal developed on conductor 65 connected to the $\overline{Q}$ output of flip-flop 91 and the DN signal from binary comparator 455.

Lamp enable circuit 484 is initially operative for inhibiting lamps 456 and 458 prior to the manipulation of a front panel control knob. The lamps 456 and 458 are therefore prevented from responding to any spurious data signals which may be stored in sample and hold circuits 430 and 440 at this time. Lamp enable circuit 484 is additionally operative for inhibiting lamps 456 and 458 in response to the detection of an equality condition between a non-analog input signal $AI_{32}$–$AI_{63}$ associated with a moved control panel knob $K_{32}$–$K_{63}$ and its corresponding stored parameter signal. In the latter case, the sample and hold circuits 430 and 440 may again be storing spurious data signals which could otherwise operate lamps 456 and 458 for providing false indications.

To illustrate the operation of lamp enable circuit 484, assume that an initial preset, corresponding to a selected programmed timber of sound, has been recalled from main memory module 70 and that no front panel controls have been manipulated by the performer. Under these conditions, the $\overline{Q}$ output of flip-flop 462 is logically high and coupled through OR gate 486 and inverter 485 as a logically low signal at the cathode of diode 483. The diode is thereby rendered conductive for discharging capacitor 482 so that a logically low signal is coupled to the control terminal of transmission gate 481 rendering the gate non-conductive. As a consequence, transistor 470 is non-conductive and no bias current is supplied to amplifier 450 whereby lamps 456 and 458 are inhibited. Next, assume that a control knob associated with an analog input signal $AI_0$–$AI_{31}$ is moved from its initial setting. An edit latch clock pulse ELC is generated at the output of OR gate 290 (FIG. 7) and clocks flip-flop 462 causing its $\overline{Q}$ output to go logically low. Since the output of AND gate 480 will also be logically low, a logically high signal is coupled to the cathode of diode 483 allowing capacitor 482 to charge and place transmission gate 481 in a conductive state. Transistor 470 is thereby rendered conductive for supplying bias current to amplifier 450. Depending on the relative value of the data signals stored in sample and hold circuits 430 and 440, either lamp 456 or lamp 458 or neither of the lamps will now illuminate.

Assume next that one of the control knobs associated with a binary input signal $AI_{32}$–$AI_{63}$ is subsequently moved. Flip-flop 462 remains set so that its $\overline{Q}$ output is still logically low. However, if a condition of equality is detected between the manipulated input signal and its corresponding stored parameter signal, a stream of DN pulses (one each system scan cycle) is coupled from AND gate 480 for repeatedly discharging capacitor 482. Transmission gate 481 and transistor 470 are therefore rendered non-conductive, no bias current is supplied to amplifier 450 and lamps 456 and 458 are inhibited for indicating the equality condition. If the manipulated input signal and the corresponding stored parameter signal are not equal, both the $\overline{Q}$ output of flip-flop 462 and the output of AND gate 480 are logically low so that bias current is supplied to amplifier 450 and either lamp 456 or lamp 458 is illuminated in response to a DL or DH signal from binary comparator 455.

HI/Lo indicator circuit 420 further includes an operational amplifier 490 having an output connected to the input of transmission gate 442. The input of amplifier 490 is connected through a voltage divider comprising a pair of resistors 491 and 492 to the slider of a trim potentiometer 493. Trim potentiometer 493 is operable for enabling a suitable voltage to be developed at the output of amplifier 490 compensating for any system offsets characterizing circuit 420. The foregoing is necessary in order to insure that neither lamp 456 nor lamp 458 is illuminated in response to the detection of an equality condition between an analog input signal associated with a moved front panel control knob $K_0$–$K_{31}$ and the corresponding stored parameter signal.

Figure 14:
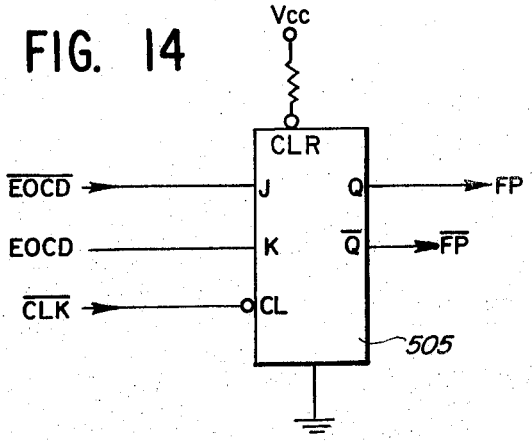
FIG. 14 illustrates a circuit embodiment for generating a signal useful in association with the present invention.

FIG. 14 illustrates a technique suitable for developing the flag pulse signal FP which frames the flag bit position of each memory word. A flip-flop 505 has its K input connected for receiving the delayed end of conversion pulses EOCD, its J input for receiving the complement signal $\overline{EOCD}$ and its clock input for receiving clock signal $\overline{CLK}$. At the time flip-flop 505 is clocked by the trailing edge of signal $\overline{CLK}$ coinciding with the beginning of the associated flag bit time, signals EOCD and $\overline{EOCD}$ are logical 0 and logical 1 respectively. Thus, the J input of the flip-flop is at logical 1 whereby the flip-flop is set producing a logical 1 signal at its Q output. At the next trailing edge of clock signal $\overline{CLK}$ (coinciding with the end of the associated flag bit time), the values of signals EOCD and $\overline{EOCD}$ reverse so that their values are logical 1 and logical 0 respectively. Thus, the J and K inputs are logical 0 and 1 respectively when the flip-flop is clocked. Consequently, the flip-flop is reset causing its Q output to go back to logical 0. Signal FP is therefore produced on the Q output of flip-flop 505 framing the flag bit position of each memory word.

To further illustrate the operation of the automatic memory override system of the present invention an exemplary sequence of performer initiated events will be described. In the exemplary sequence of events, the performer will initially recall a selected preset of main memory module 70 for controlling the sound produced by synthesizer 10. The performer will then move front panel control knob $K_3$ to a new position automatically overriding the corresponding programmed parameter signal to vary the sound otherwise produced in response to the selected preset. Next, the performer will move a second front panel control knob $K_{38}$ to a new position thereby also automatically overriding the corresponding program parameter signal and further varying the sound otherwise produced in response to the selected preset. Finally, the performer will return to control knob $K_3$ and move the knob to a second new position. The corresponding programmed parameter signal will remain overriden and the sound produced by synthesizer 10 will again be altered.

To initiate the above described sequence of events, the performer initially depresses the key switches on keyboard 42 of control panel 40 identifying the selected preset. An encoded signal representing the selected preset is supplied to input 71 of main memory module 70 for accessing the 512 bits of memory comprising the selected group of sixty-four programmed parameter signals. Address generator 60 initiates the first system scan by serially addressing the thirteen bits of the first programmed parameter signal stored in main memory module 70, the corresponding thirteen memory locations of buffer memory module 80 and the first input signal $AI_0$ supplied to multiplexer 90. At the beginning of this scan, i.e. while addressing the flag bit of the initial thirteen bit programmed parameter signal, the states of various pertinent system signals are:

PST=1; BRW=0;
Cond.65=0; FP=1;
WF=0; EOC=0.

As a result, buffer memory module 80 is placed in the write mode and stores a logical 0 signal in the flag bit position of its first memory location. During the subsequent twelve clock periods, the binary signal produced on output 67 of analog-to-digital converter 140 representing analog input signal $AI_0$ is stored in the next twelve memory locations of buffer memory module 80. During the thirteenth clock pulse, the states of the system signals are:

PST=1; BRW=0;
Cond.65=0; FP=0;
WF=0; EOC=1.

Beginning with the fourteenth clock pulse, the foregoing procedure is repeated wherein a binary representation of the second input signal $AI_1$ is stored in buffer memory module 80 preceded by a logical 0 flag bit. The buffer memory module 80 is similarly loaded from output 67 of analog-to-digital converter 140 with 13-bit binary representations of the next thirty input signals $AI_2$–$AI_{31}$, the flag bits of each signal being set to a logical 0 value.

In response to clock pulse 417, the signal on conductor 65 goes to a logical 1 state so that the final ninety-two memory locations of buffer memory module 80 are loaded with 3-bit binary encoded representations of the final thirty-two digital input signals $AI_{32}$–$AI_{63}$. As before, each loaded 3-bit word is characterized by a 0 value flag bit.

Upon initiation of the second complete system scan, the system signal states are as follows:

PST=0; BRW=1;

Cond.65=0; FP=1;

WF=0; EOC=0.

The 1 value state characterizing signal BRW places buffer memory module 80 in the read mode so that the first 13-bit word stored in buffer memory module 80 are serially coupled through edit shift register 252 and buffer digital-to-analog converter 264 to analog movement detector 270. At the same time, the first input signal $AI_0$ is also being coupled to analog movement detector 270 over multiplexer output conductor 66. Since the two signals presented to analog movement detector 270 are equal, edit latch 294 is not clocked and the second 13-bit word stored in buffer memory module 80 is in turn compared to input signal $AI_1$. This process is repeated for each of the next 13-bit words stored in buffer memory module 80 and the corresponding input signals $AI_2$–$AI_{31}$. Simultaneously therewith, bypass decoding logic 202 is continuously sampling the flag bits of each of each of the thirty-two 13-bit words stored in buffer memory 80. Since the flag bits are all at a logical 0 value, transmission gate 204 is rendered non-conductive while transmission gate 206 is rendered conductive. The first thirty-two parameter signals stored in main memory module 70 are therefore coupled in a time multiplexed manner to their respective parameter circuits for controlling the operation of synthesizer 10. In this manner, a purely programmed sound is produced corresponding to the parameter signals comprising the selected preset.

In response to the 417th clock pulse of the second system scan, the signal on conductor 65 is again placed in a logical 1 state preparing the system for comparing the succeeding thirty-two 3-bit encoded signals stored in buffer memory module 80 to their corresponding input signals $AI_{32}$–$AI_{63}$. Each of the 3-bit signals stored in buffer memory 80 is presented in turn to one input of digital movement detector 240 through edit shift register 252 while the second input of digital movement detector 240 is supplied with encoded representations of the corresponding input signals $AI_{32}$–$AI_{63}$ from the output 67 of analog-to-digital converter 140. Again, since each of the thirty-two comparisons performed by digital movement detector 240 indicate a condition of equality between these signals, edit latch 294 is not clocked so that the contents of buffer memory module 80 are not disturbed. Also, as before, the 0 state flag bits of each of the thirty-two 3-bit words stored in buffer memory module 80 enable transmission gate 206 and the multiplexer 100 for coupling signals to the parameter circuits from main memory module 70 for controlling the operation of synthesizer 10.

As long as no front panel control knobs $K_0$–$K_{63}$ are moved, the foregoing is continuously repeated with the synthesizer being controlled solely by the programmed parameter signals stored in main memory module 70. However, during some subsequent system scan the performer moves control knob $K_3$ changing the value of the associated input signal $AI_3$ from, for example, three volts to five volts. Analog movement detector 270, upon encountering this difference, causes edit latch 294 to latch the multiplexer address associated with control knob $K_3$ and input signal $AI_3$. During the following system scan, coincidence detector 292 causes write flag signal WF to assume a logical 1 state placing buffer memory module 80 in the write mode for the time frame defining input signal $AI_3$. While in the write mode, the 13-bit data word stored in buffer memory module 80 representing the initial value of input signal $AI_3$ (i.e. three volts) is updated to the new value of input signal $AI_3$ (i.e. to five volts) and its associated flag bit is set to a logical 1 value. Following the time frame defining input signal $AI_3$, write flag signal WF returns to a 0 state but the multiplexer address corresponding to input signal $AI_3$ is retained in latch 294. Now, by-pass decoding logic 202, upon sampling the logical 1 value flag bit associated with the signal stored in buffer memory module 80 representing input signal $AI_3$, enables transmission gate 204 for coupling input signal $AI_3$ from output conductor 66 of multiplexer 90 to demultiplexer 100 thereby effectively overriding the corresponding parameter signal stored in main memory module 70. Demultiplexer 100 couples input signal $AI_3$ to its respective parameter circuit on a time multiplexed basis with the remaining sixty-three non-overridden program parameter signals for controlling the synthesizer. Moreover, indicator lamps 456 and 458 operate in response to the latched address for indicating the relative value between input signal $AI_3$ and its corresponding programmed parameter signal. Thus, if the programmed parameter signal stored in main memory module 70 is, for example, two volts, HI indicator lamp 456 would illuminate indicating that the input signal $AI_3$ produced in response to the new setting of control knob $K_3$ (five volts) exceeds the corresponding programmed value of two volts.

During subsequent system scans, the system will continue to operate in the foregoing manner with synthesizer 10 being operated in response to input signal $AI_3$ and the sixty-three non-overridden programmed parameter signals. Now, at some later time, the performer, desiring to further vary the sound produced by the synthesizer, moves a second control knob, knob $K_{38}$, from its initial setting to a new setting. Digital movement detector 240 detects the difference between the value of input signal $AI_{38}$ associated with the new position of control knob $K_{38}$ and the value of the associated 3-bit memory word stored in buffer memory module 80 and representing the initial position of control knob $K_{38}$. As previously described, this results in latch 294 latching the multiplexer address associated with input signal $AI_{38}$ and in the 3-bit encoded data word stored in buffer memory module 80 representing input signal $AI_{38}$ being updated to reflect the new value of the input signal. Also, the flag bit associated therewith is set to a logical 1 value.

During subsequent system scans, bypass decoding logic 202, upon sampling the logical 1 flag bit associated with input signal $AI_{38}$ stored in buffer memory module 80, enables transmission gate 204 during the time frame defined by input signal $AI_{38}$ for coupling the input signal developed on output 66 of multiplexer 90 to demultiplexer 100 thereby overriding the corresponding programmed parameter signal stored in main memory module 70. Therefore, synthesizer 10 will now be operated in response to input signal $AI_3$ and $AI_{38}$ and the remaining sixty-two non-overridden programmen parameter signals. Also, indicator lamps 456 and 458 will be operated in response to the multiplexer address currently latched in latch 294 which corresponds to the last moved control knob $K_0$–$K_{63}$. Therefore, in the present example, the lamps will illuminate to indicate the relative value between the 3-bit encoded signal representing input signal $AI_{38}$ produced at the output 62 of analog-to-digital converter 140 and the corresponding programmed parameter signals stored in main memory module 70.

Finally, the performer now again moves control knob $K_3$ to yet another position to further alter the sound produced by synthesizer 10. Assume that the new position results in an input signal $AI_3$ having a value of one volt. Analog movement detector 270 detects the difference between the current value of input signal $AI_3$ (one volt) and the value of the corresponding word stored in buffer memory module 80 (five volts) and, in response thereto, causes write flag signal WF to assume a logical 1 value. As before, buffer memory module 80 is updated to reflect the new value of input signal $AI_3$ (one volt), with the flag bit remaining at the logical 1 value, and edit latch 294 latches the multiplexer address associated with input signal $AI_3$. Thus, input signal $AI_3$ continues to override the corresponding parameter signal stored in main memory module 70 and indicator lamps 456 and 458 are operative to reflect the relative values between the current value of input signal $AI_3$ (one volt) and the programmed parameter signal corresponding thereto (two volts). Synthesizer 10 is now operating in response to the new value of input signal $AI_3$, input signal $AI_{38}$ and the remaining sixty-two non-overridden programmed parameter signals.

It will thus be seen that memory override system 50 provides a convenient and particularly useful apparatus for automatically overriding selected programmed parameter signals used to operate a programmable synthesizer in favor of input signals associated with controls manually operated by a performer. In addition, the system provides a display indicative of the relative value between an input signal and the programmed parameter signal which it has overridden.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. In a programmable electronic musical instrument having a plurality of parameter circuits each normally controlled in response to a stored parameter signal for producing a programmed timbre of sound, a memory override system comprising:

a plurality of manually adjustable input signal sources each developing an input signal capable of controlling only a respective one of said parameter circuits; and control means responsive to manual adjustment of each of said input signal sources for causing the input signal associated with an adjusted signal source to control its respective parameter circuit in lieu of the corresponding stored parameter signal, the remaining parameter circuits being controlled in response to their respective stored parameter signals.

2. A memory override system according to claim 1 wherein each of said input signal sources comprises an input signal source operable for producing a multi-valued input signal and a manually adjustable control knob operating said input signal source for developing an input signal having a desired value, said control means being responsive to manual adjustment of said control knobs for causing the associated input signal to control its respective parameter circuit in lieu of the corresponding stored parameter signal.

3. A programmable electronic musical instrument comprising:

means including a plurality of parameter circuits each operable in response to a control signal for collectively producing a desired timbre of sound;

memory means storing a plurality of control signals each capable of operating a respective one of said parameter circuits;

a plurality of manually adjustable input signal sources each developing an input control signal also capable of operating only a respective one of said parameter circuits;

means operable for coupling to each of said parameter circuits one of said input and stored control signals associated therewith; and control means operating said coupling means for coupling to each of said parameter circuits its respective input control signal in response to manual adjustment of the associated input signal source and for otherwise coupling to each of said parameter circuits its respective stored control signal.

4. A programmable electronic musical instrument according to claim 3 wherein each of said input signal sources comprises an input signal source for producing a multi-valued input control signal and a manually adjustable control knob operating said input signal source for developing an input control signal having a desired value, said control means being responsive to manual adjustment of said control knobs for operating said coupling means for coupling the associated input control signal to its respective parameter circuit.

5. A programmable electronic musical instrument according to claim 3 wherein said control means comprises:

a buffer memory responsive to said input signal sources for storing a representation of the value of each of said input control signals during a predetermined time interval;

detection means for subsequently comparing each stored representation of an input control signal to the current value of the corresponding input control signal produced by the associated input signal source; and logic means responsive to said detection means and operating said coupling means for coupling to each of said parameter circuits its respective input control signal in response to the detection of a condition of non-equality between the current value of said input control signal and the corresponding representation thereof stored in said buffer memory and for otherwise coupling to each of said parameter circuits its respective stored control signal.

6. A programmable electronic musical instrument according to claim 5 wherein each input control signal representation stored in said buffer memory includes a flag bit and further including write means for initializing each of said flag bits to a first logical value during said predetermined time interval, said write means being responsive to said detection means for subsequently causing each flag bit associated with one of said non-equality comparisons to assume a second logical value, said logic means being responsive to each flag bit of said second logical value for causing coupling of the corresponding input control signal to its respective parameter circuit and to each flag bit of said first logical value for causing coupling of the corresponding stored control signal to its respective parameter circuit.

7. A programmable electronic musical instrument according to claim 6 wherein said write means includes means responsive to said input signal sources for updating the representation of each input control signal stored in said buffer memory and associated with a flag bit of said second logical value to reflect its current value.

8. A programmable electronic musical instrument according to claim 7 including indicator means responsive to said memory means and to said input signal sources for providing an observable manifestation of the relative value between the stored control signal and the corresponding input control signal associated with the most recently detected of said non-equality conditions.

9. A programmable electronic musical instrument comprising:

a plurality of parameter circuits operable for producing a desired timbre of sound;

memory means storing a plurality of first control signals each capable of operating a respective one of said parameter circuits;

a plurality of manually adjustable signal sources each developing a second control signal also capable of operating a respective one of said parameter circuits;

multiplex means for repetitively defining a plurality of time frames and for sequentially addressing corresponding ones of said first and second control signals during successive ones of said time frames;

coupling means responsive to said multiplex means and having first and second inputs for receiving said time multiplexed first and second control signals respectively and a plurality of outputs each connected to a respective one of said parameter circuits, said coupling means being operable for selectively coupling, during each of said time frames, one of said addressed first and second control signals to its corresponding parameter circuit; and control means responsive to said signal sources for operating said coupling means for coupling each of said second control signals to its corresponding parameter circuit in response to manual adjustment of the associated signal source from a predetermined setting and for otherwise coupling each of said first control signals to its corresponding parameter circuit.

10. A programmable electronic musical instrument according to claim 9 wherein said control means comprises:

buffer memory means addressed by said multiplex means commonly with said memory means and operable during a predetermined scan thereof for storing a binary representation of the value of each of said second control signals and, during scans subsequent thereof, for developing an output signal comprising a repetitive sequence of said stored binary representations;

detection means responsive to said output signal and to said signal sources for comparing, in turn, each stored binary representation with the current value of the corresponding time multiplexed second control signal and developing an identification signal defining the time frame associated with each non-equality comparison; and logic means operating said coupling means for coupling the second control signals occurring during time frames associated with the development of said identification signals to their respective parameter circuits and for otherwise coupling said first control signals to each of their respective parameter circuits.

11. A programmable electronic musical instrument according to claim 10 wherein said predetermined scan comprises the first scan effected by said multiplex means such that said stored binary representations reflect the values of said second control signals associated with the initial settings of said signal sources.

12. A programmable electronic musical instrument according to claim 10 wherein each second control signal binary representation stored in said buffer memory includes a flag bit and further including write control means for initializing each of said flag bits to a first logical value during said predetermined scan, said write control means being responsive to the development of one of said identification signals for causing the flag bit associated with the defined time frame to assume a second logical value, said logic means being responsive to each flag bit of said second logical value for enabling coupling of the associated second control signal to its respective parameter circuit and to each flag bit of said first logical value for enabling coupling of the associated first control signal to its respective parameter circuit.

13. A programmable electronic musical instrument according to claim 12 wherein said write control means includes means responsive to said signal sources and to said identification signal for updating the representation of each second control signal stored in said buffer memory and associated with a flag bit of said second logical value to reflect its current value.

14. A programmable electronic musical instrument according to claim 10 including first conversion means connected between the output of said buffer memory means and said detection means for converting said stored binary representations into a form enabling the comparison thereof with said second control signals.

15. A programmable electronic musical instrument according to claim 9 including second conversion means connected between said memory means and said first input of said coupling means for converting said stored first control signals into a form usable by said parameter circuits.

16. A programmable electronic musical instrument according to claim 10 wherein said multiplex means includes means for generating a plurality of address signals for commonly addressing said memory means, said buffer memory means, said signal sources, and said coupling means.

17. A programmable electronic musical instrument according to claim 16 including latch means responsive to said identification signal for latching the address signal defining the time frame associated with the most recently developed of said identification signals.

18. A programmable electronic musical instrument according to claim 17 including means for comparing the address signal stored in said latch means with the current value of said address signal and for developing a write control signal in response to a condition of equality therebetween, said write control signal enabling the flag bit associated with said latched address to assume said second logical value and further enabling the binary representation associated with said latch address to be updated to reflect the current value of the corresponding second control signal.

19. A programmable electronic musical instrument according to claim 18 including indicator means responsive to said memory means and to said signal sources for providing an observable manifestation of the relative value between the first control signal and the second control signal corresponding to the address stored in said latch means.

* * * * *